United States Patent [19]

Takagiwa et al.

[11] Patent Number: 4,557,991

[45] Date of Patent: Dec. 10, 1985

[54] TONER FOR DEVELOPMENT OF ELECTROSTATIC IMAGE CONTAINING BINDER RESIN AND WAX

[75] Inventors: Hiroyuki Takagiwa; Jiro Takahashi; Meizo Shirose; Naomi Inaba; Megumi Seki, all of Hachioji, Japan

[73] Assignee: Konishiroku Photo Industry Co., Ltd., Tokyo, Japan

[21] Appl. No.: 588,802

[22] Filed: Mar. 12, 1984

[30] Foreign Application Priority Data

| | | | |
|---|---|---|---|
| Mar. 25, 1983 | [JP] | Japan | 58-48703 |
| Mar. 25, 1983 | [JP] | Japan | 58-48704 |
| Mar. 25, 1983 | [JP] | Japan | 58-48705 |
| Mar. 25, 1983 | [JP] | Japan | 58-48706 |
| Jun. 17, 1983 | [JP] | Japan | 58-107930 |

[51] Int. Cl.[4] ..... G03G 9/08; G03G 9/14

[52] U.S. Cl. ..... 430/109; 430/106.6; 430/114

[58] Field of Search ..... 430/107, 109, 110, 111, 430/114

[56] References Cited

U.S. PATENT DOCUMENTS

| | | | |
|---|---|---|---|
| 4,132,882 | 1/1979 | Endo et al. | 118/60 |
| 4,254,201 | 3/1981 | Sawai et al. | 430/111 |
| 4,265,994 | 5/1981 | Hasegawa et al. | 430/110 |
| 4,329,415 | 5/1982 | Ikeda et al. | 430/111 |

*Primary Examiner*—John L. Goodrow

*Attorney, Agent, or Firm*—Frishauf, Holtz, Goodman & Woodward

[57] ABSTRACT

There is disclosed a toner for development of electrostatic image which comprises a binder resin selected from the group consisting of a polyester resin, a vinyl polymer, a styrene-butadiene copolymer, a styrene polymer, a styrene-containing copolymer and a polymer containing a reactive prepolymer; and a wax comprising a polyolefin.

The toner of the present invention has excellent non-offset properties and a very low minimum fixing temperature, has high fluidity and has excellent developing and transfer properties.

35 Claims, No Drawings

TONER FOR DEVELOPMENT OF ELECTROSTATIC IMAGE CONTAINING BINDER RESIN AND WAX

BACKGROUND OF THE INVENTION

This invention relates to a toner for developing electrostatic images which are formed by electrophotography, electrostatic printing, electrostatic recording or the like.

The development process of the electrostatic images comprises sucking charged fine particles by means of an electrostatic force and then depositing them on the surface of an electrostatic image support to thereby visualize the electrostatic images.

Concrete techniques of carrying out such a development process are a wet development where a liquid developing agent is employed which can be prepared by dispersing a pigment or a dyestuff into an insulating organic liquid, a dry development such as cascade development, a fur brush development, a magnetic brush development, an impression development or a powder cloud development where a powdery developing agent comprising a toner is used which can be prepared by dispersing a colorant such as carbon black into a binder comprising a naturally occurring or a synthetic resin.

The images visualized in the development process may be fixed intact on the support, but they are usually transferred to another support such as a transfer paper and are then fixed thereon. As apparent from the foregoing, the toner is subjected to not only the development process but also the subsequent processes, i.e. a transfer process and a fixing process; therefore, the toner is required to have excellent transfer and fixing properties in addition to good developing properties. Of these requirements, the fixing properties are most severe to satisfy, and research on the improvements in the fixing characteristics of the toner and their results has heretofore been published in a variety of litrature.

It is generally advantageous that a toner image formed in the development process or its transferred image be fixed by a heat fixing system and the heat fixing system include a non-contact fixing system such as an oven fixing and a contact heat fixing system such as a heat roller fixing. The contact heat fixing system advantageously has a high thermal efficiency and is suitable for a fixing step in a high-speed duplicating machine, because it permits a high-speed fixing operation, Further, since it permits a relatively low temperature heat source to be employed, the contact heat fixing system consumes less electric power; therefore, it can be contemplated to miniaturize the duplicating machine and to save energy. Furthermore, even if papers happen to stagnate in a fixing device, no ignition will occur, which fact is an additional advantage of the contact heat fixing system.

Although it is excellent in various points as described above, the contact heat fixing system has such serious problems as the occurrence of offset development. This is the phenomenon in which a part of the toner constituting an image is transferred to the surface of a heat roller at the time of the fixing operation and the partially transferred toner is transferred again to the next transfer paper or the like thereby soiling the paper. For the purpose of preventing this offset phenomenon, a variety of suggestions has heretofore been made and some of them have been put into practice. One such system comprises carrying out the fixing while an oily parting agent such as silicone oil is applied to the surface of the heat roller, and others thereof contemplate providing the toner itself with an offset preventing ability. The latter are excellent in that silicone oil applicator is not needed. Accordingly the structure of the fixing device can be simplified and any maintenance to replenish silicone oil or the like is not necessary.

The offset phenomenon tends to occur when the temperature of the heat roller is raised; therefore, if a minimum temperature (hereinafter referred to as the offset phenomenon occurring temperature), which the toner has and above which the offset phenomenon will occur, is at a higher level, the toner can be considered to be better in non-offset properties. However, in order to permit the toner to be fixed, the toner is required to be heated up to a temperature of its softening point or more. Accordingly, in the real heat roller fixing device, the temperature of the heat roller is set to a specified level within a fixable temperature section in a range between the softening point of the toner up to the offset occurring temperature.

In fact, the temperature of the heat roller cannot be completely uniformly maintained at a set temperature and there are other factors to be considered regarding the temperature. Therefore, a toner which has an extensive fixable temperature section and which can maintain the advantages of the contact heat fixing system is suitable.

As a binder for the toner, a styrene resin and a vinyl polymer have heretofore widely been used because they are easy to manufacture, low in cost and generally have preferred properties as the binder. With the toner including the vinyl polymer as the binder, it has been suggested to employ a high molecular weight polymer for the purpose of obtaining the non-offset properties. However, such a high molecular weight vinyl polymer has a high softening point. Accordingly, it is hard to procure an extensive fixable temperature section even though the offset occurring temperature is raised to a high level. In consequence, any suitable toner has not yet been prepared.

On the other hand, with regard to a polyester resin, since its low molecular weight resin can be obtained comparatively easily, toner having a low softening point can be prepared by employing such a resin as the binder. Further, as compared with the toner including the vinyl polymer as the binder, the toner including the polyester resin is better in "wetting" to such a support as the transfer paper when molten, with the result that the polyester resin toner advantageously permits the sufficient fixing at a lower temperature than occurs with the vinyl polymer toner which has a substantially similar softening point.

Moreover, judging from the fact that the toner is deposited on the electrostatic image support by virtue of an electrostatic attraction force and in certain cases it is further transferred to another support, it is required that the toner has a generally uniform and stable frictional chargeability. A usual way of providing the toner with the frictional chargeability is to incorporate a charge controlling agent such as a dyestuff into resin particles constituting the toner. Therefore, a severe condition of uniformly dispersing the charge controlling agent in the resin is additionally imposed on the manufacturing process of such a toner. However, since the polyester resin itself has a suitable frictional chargeability, such an incorporation of the charge controlling agent is unnecessary, or even if necessary, a lower amount will suffice. In short, if the polyester resin is employed as the binder, the preparation of the toner can be very highly easily accomplished.

However, the toner including the polyester resin as the binder usually has the drawback that its offset occurring temperature is low.

Further, when a styrene resin alone is employed as the binder, more problems requiring improvement are observed. Particularly, in order to raise the offset occurring temperature of the toner in which the styrene resin is used as the binder, a high molecular weight component incorporated into the binder resin of the toner is effective. However, if it is attempted to provide the toner with the sufficient non-offset characteristics by this manner, the softening point of the resin will be high, which fact will lead to a rise of the minimum temperature (hereinafter referred to as the minimum fixing temperature) necessary for the fixing of the toner, so that the advantages of the contact heat fixing system will be lost. It is, needless to say, desirable that the minimum fixing temperature below and in order to form visible images on both surfaces of one transfer paper sheet, which has been recently increasingly desired, the toner must be able to be fixed at a low temperature.

In view of this background, for the purpose of preparing the toner which has the non-offset characteristics and a low minimum fixing temperature, there have been developed techniques in which a ratio Mw/Mn of a weight average molecular weight Mw to a number average molecular weight Mn of the binder resin has been increased to raise a cohesive force of the toner at the time of its melting and another technique in which a wax having a low softening point and comprising a parting agent such as a polypropylene or a polyethylene wax is incorporated into the toner particles in order to lower the minimum fixing temperature.

In the former technique, however, when it is intended to obtain the sufficient non-offset characteristics, the minimum fixing temperature rises and when a particular binder resin is selected with the aim of inhibiting such a temperature rise, its glass transition temperature drops, so that the toner tends to cohere.

Accordingly, a combination of the former technique and the latter could be presumed; but when the technique wherein the low softening point-having wax is incorporated into the toner is employed, the powdery toner is poor in fluidity and developing and transfer characteristics are also lowered, so that good visible images cannot be formed. Additionally, such a toner tends to bring about cohesion. Further, in order to obtain an effect resulting from the addition of the wax, an amount proportion of the wax must be enhanced up to a relatively high level. If done, however, the wax component will adhere to a developing sleeve or an electrostatic charge support, thereby forming a coating film thereon, so that its function is disadvantageously obstructed.

For the improvement in a fluidity of the toner, adding a fluidity improver comprising a hydrophobic silica fine powder to the toner powder is effective; but in order to give the sufficient fluidity to the toner in which the low softening point wax is contained, it is necessary to add a great deal of the hydrophilic silica fine powder thereto. If such a powder is actually used, the surface of the electrostatic image support is damaged by the hydrophobic silica fine powder which is very hard and when the support is a light conductive sensitizer, its the problem is serious. Further, if cleaning the surface of the electrostatic image support is carried out by a rubber blade, the blade becomes violently worn. Furthermore, in an image forming device having a recycle and reuse system for returning to the developing device, there is toner which has been fed thereto for the development but which has not been utilized for the formation of the toner image are the fine particles of the hydrophobic silica become embedded in the surface portions of the toner particles to lower the fluidity of the toner, whereby the formed visible image is poor in quality.

The present invention has been achieved over the background of the aforementioned situations and its object is to provide a toner for development of electrostatic images which has sufficient non-offset characteristics, a low minimum fixing temperature, a high fluidity and less cohesiveness which and always permits stable forming of good visible images.

SUMMARY OF THE INVENTION

The aforesaid object is accomplished by a toner, for use in a development of electrostatic charge images, characterized by including:

(1) a binder resin selected from the group consisting of a polyester resin containing 5% by weight or more of its chloroform-insoluble content; a polymer of a vinyl monomer containing 0.005% by weight or more of a cross-linking agent monomer with respect to the total monomers; a styrene-butadiene copolymer (hereinafter referred to as the S-B copolymer) containing 10% by weight or more of a high molecular weight component having a molecular weight of 100,000 or more; a polymer of a styrene monomer or a copolymer of the styrene monomer and another vinyl monomer, a ratio of its weight average molecular weight with respect to its number average molecular weight being 3.5 or more; and a polymer formed by polymerization of a polymerizable monomer in the presence of a reactive prepolymer; and (2) a wax comprising a polyolefin which has been block copolymerized or graft copolymerized with an aromatic vinyl monomer.

DESCRIPTION OF THE PREFERRED EMBODIMENTS

The invention is described in detail below.

In the invention, a toner for development of electrostatic images is prepared by incorporating a wax into particles of a polymer as a binder resin together with a colorant, a charge controlling agent and other essential toner components, and the polymer is selected from the group consisting of a polyester resin containing 5% by weight or more of its chloroform-insoluble content; a cross-linked polymer formed by polymerizing a polymer composition which has been prepared by incorporating a cross-linking agent monomer into a vinyl monomer in such a ratio that an amount of the cross-linking agent is 0.005% by weight or more, preferably within the range of 0.1 to 5% by weight with respect to the total monomers; a styrene-butadiene copolymer containing 10% by weight or more of a high molecular weight component having a molecular weight of 100,000 or more; a polymer formed by polymerizing one or more styrene monomers or a copolymer formed by copolymerizing the styrene monomer and another vinyl monomer copolymerizable therewith, a ratio of Mw/Mn of its weight average molecular weight Mw with respect to its number average molecular weight Mn being 3.5 or more, preferably 5 or more; and a polymer formed by polymerization of a polymerizable monomer in the presence of a reactive prepolymer;

and the aforesaid wax comprises a polymer formed by block copolymerizing an aromatic vinyl monomer and a polyolefin, or a polymer formed by graft copolymerizing the aromatic vinyl monomer on backbones of the polyolefin, i.e. the polyolefin (hereinafter referred to as the modified polyolefin) modified with the aromatic vinyl monomer.

The amount of the wax to be included is within the range of 1 to 20% by weight, preferably 1 to 10% by weight. When its amount is less than 1% by weight, any effect of the wax as the parting agent will not be exhibited and the non-offset characteristics of the toner will not be thus improved. On the contrary, when it is more than 20% by weight, the fluidity of the toner will be lowered, which fact brings about a deterioration in developing properties and transfer properties, so that good visible images are not formed. Additionally, in such a case, the wax adheres to the developing sleeve or the electrostatic image support in order to form a coating film thereon, thereby impairing its function.

As understood from the foregoing, in the instance where the binder resin comprises the polyester resin including a high molecular weight component not less than a certain amount which is insoluble in chloroform, the toner according to this invention has a high offset occurring temperature and is thus excellent in non-offset characteristics, in addition to an effect inherent in the polyester resin; and in the instance where the vinyl polymer cross-linked by the cross-linking agent monomer is employed as the binder, its molecular weight is high, whereby the offset occurring temperature is raised and the excellent non-offset characteristics are thus obtained.

Further, in the instance where the binder resin used comprises the S-B copolymer including 10% by weight or more of a high molecular weight component having a molecular weight of 100,000 or more, the toner according to this invention has a high offset occurring temperature, since this binder resin itself has non-offset characteristics; in the instance where the styrene polymer or the styrene containing copolymer having an Mw/Mn ratio of 3.5 or more is employed as the binder resin, a cohesion at a melting step of the toner is high and its softening point is low, and even better, the binder resin itself has non-offset characteristics and can control the minimum fixing temperature to a lower level; and in the instance where the polymer which is obtained by the polymerization of a polymerizable monomer in the presence of a reactive prepolymer is employed as the binder resin, the offset occurring temperature is raised and excellent non-offset characteristics are obtained.

When composed of the binder resin having the aforesaid advantages and the already mentioned wax comprising the modified polyolefin, the toner of this invention has high offset occurring temperature and nevertheless the low minimum fixing temperature; therefore, it is suitable for a high-speed fixing operation by the use of a heat roller fixing device, as will be clear from the description on the undermentioned examples. Further, since the deterioration in the fluidity of the toner due to the addition of the wax is small, it is not needed to add a fluidity improver such as a hydrophobic silica fine powder to obtain the necessary fluidity. Even if such an addition is required, a small amount suffices; therefore, some disadvantages resulting from adding a large amount of the hydrophobic silica fine powder are avoided. Further, the toner just described has less cohesion and excellent storability. In short, the toner, according to this invention, having high fluidity and less cohesion permits good development and fixing at a low temperature and a high speed, whereby excellent visible images having a high image density are always stably formed. In addition thereto, since the toner according to this invention has the low minimum fixing temperature, it is not needed to subject a toner image support such as a paper to a high temperature at the time of the fixing, and since wrinkles thus do not occur thereon, the visible images can practically be formed on both surfaces of the support by the use of the above toner.

The reason why the toner according to this invention has such advantageous properties as mentioned above is not yet clearly elucidated, but it can be presumed that the minimum fixing temperature drops while the offset occurring temperature is maintained at a high level, since the toner includes the wax comprising a polyolefin, together with the binder resin; and that the polyolefin is a modified polyolefin which includes, in its molecular structure, a modified component showing an affinity to the binder; therefore, the modified component is high in compatibility with the binder and has less adhesion and larger fluidity than an unmodified polyolefin wax.

The polyester resin used in this invention as the binder resin can be prepared by a condensation polymerization of an alcohol and a carboxylic acid. Examples of the usable alcohols include diols such as ethylene glycol, diethylene glycol, triethylene glycol, 1,2-propylene glycol, 1,3-propylene glycol, 1,4-butane diol, neopentyl glycol and 1,4-butene diol; 1,4-bis-(hydroxymethyl)cyclohexane; etherificated bisphenols such as bisphenol A, hydrogenated bisphenol A, polyoxyethylene modified bisphenol A and polyoxypropylene modified bisphenol A; and other divalent alcohol monomers.

Examples of carboxylic acids include maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid, malonic acid, and acid anhydrides of the above mentioned acids; dimers of a lower alkyl ester and linolenic acid; and other divalent organic acid monomers.

As the polyester resins used in this invention, not only polymers of the aforesaid bifunctional monomers alone but also polymers including components of trifunctional and more multifunctional monomers are preferred. Examples of multivalent alcohol monomers having trivalent or more which are the multifunctional monomers include sorbitol, 1,2,3,6-hexanetetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethyl benzene and others.

Examples of multivalent carboxylic acid monomers having trivalent or more include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxyl)methane, 1,2,7,8-octanetetracarboxylic acid and empole trimer acids; and acid anhydrides of the above mentioned acids and others.

The component of the aforesaid trifunctional or more multifunctional monomers is preferably included in a proportion of 30 to 80 mole % of the alcohol component or the acid component comprising a structural unit in the polymer.

The polyester resin used in this invention includes 5% by weight or more of its chloroform-insoluble content. The chloroform-insoluble content is defined as a filter paper-impermeable content of the resin sample when the latter is dissolved in chloroform, and it can be obtained as follows:

A resin sample is finely ground, and 5.00 g of the sample powder which has passes through a 40-mesh sieve are collected and are placed in a 150 ml vessel together with 5.00 g of a filter aid, Radiolite (No. 700). Into this vessel, 100 g of a chloroform are poured, and the vessel is put on a stand of a ball mill and is rotated for a period of 5 hours or more in order to dissolve the sample in chloroform. Separately, a filter paper (No. 2) of 7 cm in diameter is set to a pressure filter and is uniformly precoated with 5.00 g of Radiolite, and a small amount of chloroform is dropped on the filter paper so as to cause the latter to adhere to the filter. Afterward, the already prepared sample solution in the vessel is poured into the filter. The vessel is further washed enough with 100 ml of chloroform so that no deposit remains on the wall of the vessel, and the wash liquid is then poured into the filter. Subsequently, the filter is closed with a lid and filtration is carried out under a pressure of 4 kg/cm$^2$ or less. After the flow of chloroform has stopped, an additional 100 ml of chloroform are added to the filter to clear it from the remainder on the filter paper and the pressurizing filtration is carried out again.

After the above procedure has been completed, all of the filter paper, the residue thereon and Radiolite are put on an aluminum foil and are placed in a vacuum dryer. Drying was carried out for 10 hours under conditions of a temperature of 80° to 100° C. and a pressure of 100 mmHg, and after a while a total weight "a" (in grams) of the dried material is measured to obtain a chloroform-insoluble content "x" (% by weight) in accordance with the following equation:

$$X\,(\%\text{ by weight}) = \frac{a(\text{g}) - \text{weight of filter paper(g)} - \text{weight of Radiolite (10.00 g)}}{\text{Sampling weight (5.00 g) of sample}} \times 100$$

In the case of the polyester resin, its chloroform-insoluble content thus obtained is a high molecular weight polymer component or a cross-linked polymer component, the molecular weight of which would be approximately 200,000 or more.

As is clear from the foregoing, the chloroform-insoluble content can be formed in a fairly controlled proportion by choosing proper reaction conditions or by causing a suitable cross-linking agent to exist in a reaction system in the above-mentioned polymerization reaction of the alcohol with the carboxylic acid.

In this invention, the polyester resin in which the chloroform-insoluble content thereof is 5% by weight or more is employed as the binder; if the polyester resin in which the chloroform-insoluble content is less than 5% by weight is employed, the obtained toner will inconveniently have a lower offset occurring temperature.

Preferred examples of vinyl series monomers, from which the polymers capable of being used as the binder resins in this invention are prepared, include styrene monomers such as styrene, o-methylstyrene, m-methylstyrene, p-methylstyrene, α-methylstyrene, 2,4-dimethylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and the like. In addition to these, examples of the vinyl series monomers further include ethylenic unsaturated monoolefins such as ethylene, propylene, butylene and isobutylene; halogenated vinyl monomers such as vinylchloride, vinylidene chloride, vinyl bromide and vinyl fluoride; vinyl esters such as vinyl acetate, vinyl propionate, vinyl benzoate and vinyl lactate; α-methylene aliphatic mono-carboxylic acid esters such as methyl acrylate, ethyl acrylate, propyl acrylate, n-butyl acrylate, iso-butyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, iso-butyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate; acrylic acid derivatives or methacrylic acid derivatives such as acrylonitrile, methacrylonitrile and acrylamide; vinyl ethers such as vinyl methyl ether, vinyl ethyl ether and vinyl iso-butyl ether; vinyl ketones such as vinyl methyl ketone, vinyl hexyl ketone and methyl iso-propenyl ketone; N-vinyl compounds such as N-vinyl pyrrol, N-vinyl carbazol, N-vinyl indole and N-vinyl pyrrolidone; vinyl naphthalenes and others. These monomers may be used alone or in a combination thereof, and such combinations in which copolymers are formed due to polymerization may also be employed.

The cross-linking agent monomers which are used together with the aforesaid monomers are mainly compounds each have two or more polymeric double bonds, and examples of such cross-linking agent monomers include aromatic divinyl compounds such as divinyl benzene, divinyl naphthalene and their derivatives; diethylenic carboxylic acid esters such as diethyleneglycol acrylate, diethyleneglycol methacrylate, triethyleneglycol methacrylate, trimethylolpropane triacrylate, allyl methacrylate, t-butylaminoethyl methacrylate, tetraethyleneglycol dimethacrylate, 1,3-butanediol dimethacrylate, ethyleneglycol dimethacrylate and tetramethylolmethane acrylate; all the divinyl compounds such as N,N-divinyl aniline, divinyl ether, divinyl sulfide and divinyl sulfone; and a compound having three or more vinyl groups. These monomers may be used alone or in mixture. The proportion of the cross-linking agent monomer with respect to the whole monomers is within the range of 0.005 to usually 20% by weight, preferably 0.1 to 5% by weight. If this proportion is less than 0.005% by weight, the produced polymer will have a low molecular weight, and the toner obtained therefrom will have a low offset occurring temperature. On the other hand, if this proportion is large, the minimum fixing temperature will rise. The aforesaid level of 20% by weight is not a limit, and for example, if a chain transfer agent or the like is used, the above proportion can exceed the level of 20% by weight.

The S-B copolymers used as the binder resins in this invention can be prepared by copolymerizing styrene monomers and butadiene. Examples of the styrene monomers include styrene, o-methylstyrene, m-methylstyrene, p-methylstyrene, α-methylstyrene, p-ethylstyrene, 2,4-dimethylstyrene, p-n-butylstyrene, p-n-dodecylstyrene, p-methoxystyrene, p-phenylstyrene, p-chlorostyrene and others.

The aforesaid S-B copolymer is required to contain high molecular components each having a molecular weight of 100,000 or more, and the proportion of such contained components must be 10% by weight or more. If the proportion of the high molecular weight components is less than 10% by weight, the non-offset property of the binder resin itself will be lost, with the result that the offset occurring temperature will be lowered.

When the high molecular weight components each having a molecular weight of 100,000 or more are included therein within the range of 10 to 70% by weight, the offset occurring temperature will rise and the softening point will drop, which fact is particularly preferable. The molecular weights referred to in this specification can be measured in accordance with a gel permeation chromatography method under conditions below. That is to say, the measurement can be made by injecting 4 mg of a 0.2 g/dl tetrahydrofuran sample solution into a chromatographic column while a solvent (tetrahydrofuran) is caused to flow at a temperature of 25° C. at a flow rate of 1 ml/min, with the aid of "Water's 200 Type GPC measuring apparatus" (produced by Water's Co., Ltd.). The column used comprises a combination of $10^6-10^6-10^5-10^4$.

As monodisperse polystyrene standard samples to prepare a calibration curve, there may be used polystyrenes having molecular weights of 1,800,000, 860,000, 411,000, 160,000, 98,200, 51,000, 19,800, 10,000 and 4,000 which have been made by Pressure Chemical Co., Ltd. In this case, tetrahydrofuran-insoluble high molecular components at the time of the measurement have molecular weights of 500,000 or more which are more than the molecular weight, 100,000 or more, of the high molecular components used in this invention.

The S-B copolymer in this invention preferably contains 70 to 98% by weight, particularly 85 to 98% by weight of components regarding the styrene (hereinafter referred to as the styrene components). When the S-B copolymer in which the proportion of the contained styrene components is less than 70% by weight is used, the glass transition point of the binder resin will drop, and the obtained toner will be cohesive and will become masses during storing or in a developing vessel. On the other hand, when the S-B copolymer in which the styrene components are contained more than 98% by weight is used, the softening point of the binder resin will be raised and a fixable temperature range will become narrow.

As the binder resins for the toner of this invention, there are further employed styrene resins having an Mw/Mn value of 3.5 or more, such as polymers or copolymers of styrene monomers, i.e. polymers and copolymers of one or more kinds of styrene monomers, or such as copolymers of the styrene monomers and vinyl monomers.

Examples of the above-mentioned styrene monomers include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and the like.

As the aforementioned copolymers of the styrene monomers and the vinyl monomers, styrene-butadiene copolymers or styrene-acrylate copolymers are particularly preferable. Examples of the acrylic monomers for acrylic components include α-methylene aliphatic mono-carboxylic acid esters such as methyl acrylate, ethyl acrylate, propyl acrylate, n-butyl acrylate, isobutyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate; acrylic acid derivatives or methacrylic acid derivatives such as acrylonitrile, methacrylonitrile and acrylamide; and others. These monomers may be used alone or in a combination thereof.

The styrene resins mentioned above have an Mw/Mn ratio of 3.5 or more, but those of the Mw/Mn ratio being 5 or more are preferred and those of a molecular weight being approximately 2,000 to 30,000 in terms of Mn are particularly desirable. The values of Mw, Mn and Mw/Mn can be measured in a variety of manners, and there is a little variant in accordance with selected measuring manners. Therefore, it should be noted that the values of Mw, Mn and Mw/Mn referred to herein are those that have been measured by the following procedure.

That is, the aforesaid respective values can be measured in accordance with the gel permeation chromatography under conditions described below. A solvent (tetrahydrofuran) is caused to flow at 25° C. at a flow rate of 1 ml/min, and 8 mg of a 0.4 g/dl tetrahydrofuran sample solution are injected into a chromatographic column in order to carry out the measurement. At the molecular weight measurement of the sample, measurement conditions are selected under which a molecular weight distribution lies within the range where a logalithm and a count of a molecular weight on a calibration curve prepared by the use of some kinds of monodisperse polystyrene standard sample ($Mw=28.8\times10^4$, $Mn=13.7\times10^4$ and $Mw/Mn=2.11$) has shown an Mw/Mn of $2.11\pm0.10$ when subjected to the aforesaid measurement conditions.

This invention can achieve the above-mentioned object by the use of the styrene resin having the Mw/Mn of 3.5 or more with the styrene resins having the Mw/Mn of 5 or more being particularly effective to prevent the offset phenomenon.

Further, the styrene resin in which the softening point based on a ring and ball test is approximately 100° to 170° C. is particularly effective on the whole, though it varies with a kind of monomer contained as a constitutional component in the styrene resin. Furthermore, the styrene resin having the glass transition point of 40° C. or more is also particularly effective. If the softening point is 100° C. or less, the formed polystyrene resin will tend to be excessively pulverized and a photoconductive light-sensitive plate will be liable to be contaminated by a toner filming phenomenon. On the contrary, if the softening point is in excess of 170° C., the polystyrene resin will be too hard to be pulverized and a great deal of calories will be required for the fixing process, with the result that the fixing efficiency is disadvantageously bad. On the other hand, if the glass transition point is less than 40° C., the prepared resin will tend to become masses by a cold flow phenomenon, in view of the fact that the toner is usually stored at a temperature of 40° C. or less.

Generally, as the Mw/Mn value is getting great, the glass transition point of the styrene resin is scattered more and more, so that it will be difficult to obtain a specified glass transition point. Therefore, in some resins having the large Mw/Mn values, the glass transition points are hard to measure.

The above-mentioned styrene resins may be synthesized in accordance with the following procedure: When a usual polymerization is employed, resins of the Mw/Mn being 1.5 to 3.0 will be prepared. However, in order to obtain resins having the Mw/Mn value of 3.5 or more which are used in this invention, the following procedure may be utilized. That is, according to one method, a polymerization is made by continuously or intermittently changing a polymerization temperature. According to another method, divinyl compounds and trivinyl compounds are used together for the polymerization. According to still another method, the polymerization is made by adding some monomers which are different in concentrations of an initiator and a chain transfer agent therein. Particularly, when a high molecular weight resin is mixed with a relatively low molecular weight resin, a resin having the great Mw/Mn value can easily be prepared. These methods can be accomplished by a mass polymerization, a solution polymerization, a suspension polymerization or an emulsion polymerization. However, because of easy handling properties of the obtained resin and a reduced manufacturing cost, the emulsion polymerization is best. As techniques for increasing the Mw/Mn value, there are a method of dissolving, in a solvent, some resins having different molecular weights and then removing the solvent by virture of a vacuum drying or a spray drying, and a method in which a thermal dissolution is carried out to blend materials. In order to achieve the above-mentioned object of this invention, however, it is preferred that materials are uniformly dispersed. A manufacturing method of the styrene resin regarding this invention is described in, for example, the specification of U.K. Pat. No. 1,495,428.

Next, the binder resin obtained by the polymerization of a polymerizable monomer in the presence of a reactive prepolymer of this invention will be described.

Examples of the polymerizable monomers to obtain a polymer for use to the binder resin of the present invention are described as follows:

Examples of the preferred vinyl series monomers include styrene, o-methyl styrene, m-methyl styrene, p-methyl styrene, α-methyl styrene, p-ethylstyrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-phenyl styrene, p-chlorostyrene, 3,4-dichlorostyrene and the like. As the other vinyl series monomers as mentioned above, there may be exemplified ethylenic unsaturated mono-olefins such as ethylene, propylene and isobutylene; vinyl halides such as vinyl chloride, vinylidene chloride, vinyl bromide and vinyl fluoride; vinyl esters such as vinyl acetate, vinyl propionate, vinyl benzoeate and vinyl lactate; α-methylene aliphatic mono-carboxylic acid esters such as methyl acrylate, ethyl acrylate, propyl acrylate, n-butyl acrylate, iso-butyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, iso-butyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate; acrylic acid derivatives or methacrylic acid derivatives such as acrylonitrile, methacrylonitrile and acrylamide; vinyl ethers such as vinyl methyl ether, vinyl ethyl ether and vinyl iso-butyl ether; vinyl ketones such as vinyl methyl ketone, vinyl hexyl ketone and methyl iso-propenyl ketone; N-vinyl compounds such as N-vinyl pyrrole, N-vinyl carbazole, N-vinyl indole and N-vinyl pyrrolidone; vinyl naphthalenes and others. These monomers may be used alone or in combination of two or more, and may be combined to provide a copolymer through polymerization.

In addition to the vinyl series monomers as mentioned above, there may be used polymerizable monomers as shown below.

As polymerizable monomers to obtain polyester resins, there may be mentioned, for example, dibasic acids such as terephthalic acid, isophthalic acid, adipic acid, maleic acid, succinic acid, sebatic acid, thiodiglycolic acid, diglycol acid and the like; and glycols such as ethylene glycol, diethylene glycol, 1,4-bis(2-hydroxyethyl)benzene, 1,4-cyclohexane dimethanol, propylene glycol and the like.

As polymerizable monomers to obtain polyamide resins, there may be mentioned caprolactam, and further dibasic acids such as terephthalic acid, isophthalic acid, adipic acid, maleic acid, succinic acid, sebatic acid, thiodiglycolic acid and the like; and diamines such as ethylene diamine, diaminoethylether, 1,4-diaminobenzene, 1,4-diaminobutane and the like.

As polymerizable monomers to obtain polyurethane resins, there may be mentioned, for example, diisocyanates such as p-phenylene diisocyanate, p-xylylene diisocyanate, 1,4-tetramethylene diisocyanate and the like; and glycols such as ethylene glycol, diethylene glycol, propylene glycol, polyethylene glycol and the like.

As polymerizable monomers to obtain polyurea resins, there may be mentioned, for example, diisocyanates such as p-phenylene diisocyanate, p-xylylene diisocyanate, 1,4-tetramethylene diisocyanate and the like; and diamines such as ethylene diamine, diaminoethylether, 1,4-diaminobenzene, 1,4-diaminobutane and the like.

As polymerizable monomers to obtain epoxy resins, there may be mentioned, for example, amines such as ethyl amine, butyl amine, ethylene diamine, 1,4-diaminobenzene, 1,4-diaminobutane, monoethanol amine and the like; and diepoxy compounds such as diglycidyl ether, ethylene glycol diglycidyl ether, bisphenol A diglycidyl ether, hydroquinone diglycidyl ether and the like.

The polymerization of the above-mentioned polymerizable monomer is carried out in the presence of a reactive prepolymer. As the prepolymer, any prepolymer is employed which is usually used by a person skilled in the art, and more specifically, it is referred to as a reactive prepolymer. The reactive prepolymer is a prepolymer having a reactive group (or an atom) which is capable of being reactive with a polymerizable monomer at a main chain and/or a side chain of the polymer. Those reactive groups which may be mentioned as representative are a carboxyl group (—COOH), a sulfo group (—$SO_3H$), an ethylene imino group

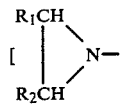

(wherein $R_1$ and $R_2$ each represent a hydrogen atom or an alkyl group such as a methyl group and the like)], an isocyanate group (OCN—),
a double bond group (—CH=CH—),
an acid anhydride

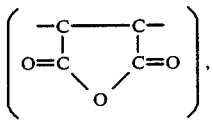

an epoxy group

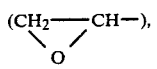

a halogen atom and the like.

A reaction of the reactive group of the above mentioned prepolymer with the polymerizable monomer includes various types of reaction such as a type which reacts only by a mixing of them, a type which reacts in the presence of a catalyst such as a polymerization initiator and the like, and a type which reacts by irradiation of light in the case of a monomer having a cinnamoyl group. The molecular weight of these prepolymers are employed having any molecular weight, but usually used having 1,000 to 500,000, preferably 1,000 to 50,000.

In the following, representative examples of these prepolymers are mentioned:

[As the prepolymers having an epoxy group;]

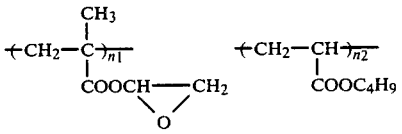

(1)

($n_1$:$n_2$ = 10:90)

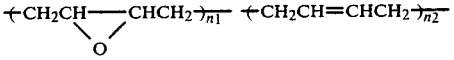

(2)

($n_1$:$n_2$ = 40:60)

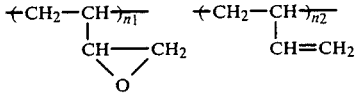

(3)

($n_1$:$n_2$ = 30:70)

-continued

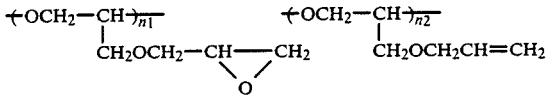

(4)

($n_1$:$n_2$ = 50:50)

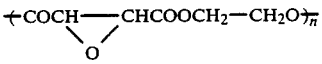

(5)

[As the prepolymers having an ethyleneimino group;]

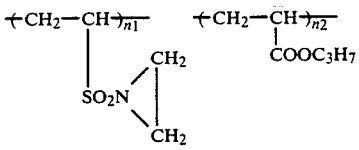

(6)

($n_1$:$n_2$ = 30:70)

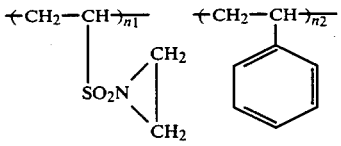

(7)

($n_1$:$n_2$ = 60:40)

[As the prepolymers having an isocyanate group;]

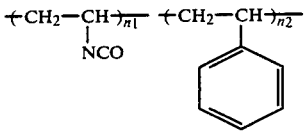

(8)

($n_1$:$n_2$ = 20:80)

[As the prepolymers having a double bond group;]

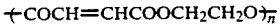

(9)

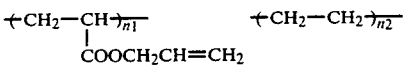

(10)

($n_1$:$n_2$ = 60:40)

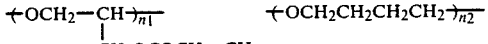

(11)

($n_1$:$n_2$ = 50:50)

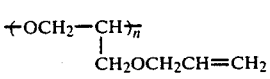

(12)

[As the prepolymers having an acid anhydride group;]

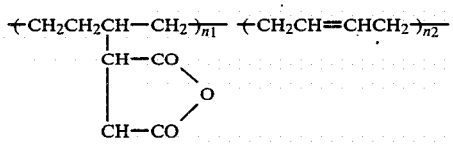

(13)

$(n_1:n_2 = 60:40)$

[As the prepolymers having a carboxyl group;]

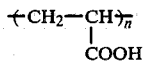

(14)

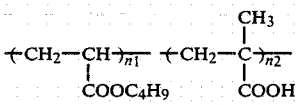

(15)

$(n_1:n_2 = 30:70)$

[As the prepolymers having a sulfo group;]

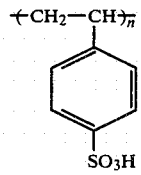

(16)

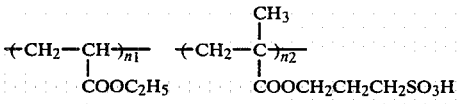

(17)

$(n_1:n_2 = 60:40)$

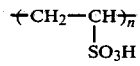

(18)

[As the prepolymers which are cross-linked and polymerize by the irradiation of light;]

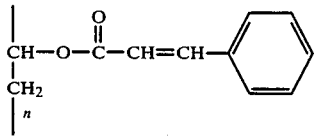

(19)

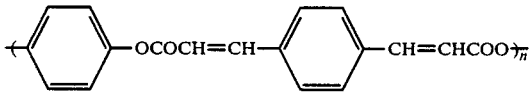

(20)

In addition to the above-mentioned prepolymers, butadiene series prepolymers such as poly-1,2-butadiene, α,ω-polybutadiene glycol, maleic polybutadiene and terminal acryl-modified polybutadiene can be used.

In the aforesaid polymerizable monomers, the vinyl series monomers are particularly preferred. As the reactive prepolymers which is used in combination with the vinyl series monomers, butadiene series prepolymers or unsaturated polyester resins are preferred.

Examples of the preferred butadiene series prepolymers include butadiene polymer, α,ω-polybutadiene homopolymer, α,ω-polybutadieneglycol, α,ω-polybutadiene dicarboxylic acid, maleic polybutadiene, terminal acryl-modified polybutadiene and terminal half-ester-modified polybutadiene. These butadiene series prepolymers are used alone or in a combination thereof.

Further, the preferable unsaturated polyester resins mentioned above are the polyester resins obtained from at least one of a divalent alcohol selected from the group A as described below and at least one of a dibasic acid selected from the group B as described below, which are described as a monomer unit. The dibasic acid selected from the group B contains at least one of an unsaturated dicarboxylic acid such as fumalic acid, maleic acid, itaconic acid and the like.

Group A: ethylene glycol, triethylene glycol, 1,2-propylene glycol, 1,3-propylene glycol, 1,4-butandiol, neopentyl glycol, 1,4-butenediol, 1,4-bis(hydroxymethyl)cyclohexane, bisphenol A, hydrogenated bisphenol A, polyoxyethylenic bisphenol A.

Group B: maleic acid, fumalic acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, or acid anhydrides of the above acids; or esters of these acids with a lower alcohol.

Moreover, the principal polymer chain of the above-mentioned unsaturated polyester resins may contain, as a monomer component, at least one of trivalent or more of an alcohol or a carboxylic acid as mentioned in the following group C.

Group C: glycerin, trimethylol propane, pentaerythritol, trimellitic acid, pyromellitic acid.

The reactive prepolymers mentioned above may be contained in the range of 0.1 to 40% by weight, preferably 1 to 20% by weight based on the polymer composition.

In the polymerization process of the above-mentioned polymerizable monomers in the presence of the prepolymer, when they are polymerized through cross-linking reaction, addition reaction, graft polymerization of the like, it is preferred that a polymerizable monomer having a functional group which reacts directly with the functional group of the prepolymer or a polymerizable monomer having a functional group which is able to react through a cross-linking agent coexists in a part of the composition of the polymerizable monomers.

Examples of the polymerizable monomers which have a functional group capable of reacting with a functional group of the prepolymer include, as the polymerizable monomers, in the instance where the functional group of the prepolymer is an epoxy group or an ethyleneimino group, a polymerizable monomer having a functional group which is capable of reacting with an epoxy group or an ethyleneimino group such as an amino group and a carboxy group, more specifically, 2-aminoethylmethacrylate.hydrochloric acid salt, N-(2-aminoethyl)acrylamide.hydrochloric acid salt, methacrylic acid and acrylic acid; in the instance where the functional group of the prepolymer is an isocyanate group or an acid anhydride group, a polymerizable monomer having a functional group which is capable of reacting with an isocyanate group or an acid anhydride group such as an amino group, a carboxy group and a hydroxyl group, more specifically, 2aminoethyl methacrylate.hydrochloric acid salt, N-(2-aminoethyl)- acrylamide.hydrochloric acid salt, methacrylic acid, acrylic acid, 2-hydroxyethyl methacrylate and p-hydroxystyrene; in the instance where the functional group of the prepolymer is a carboxy group or a sulfo group, a polymerizable monomer having a functional group which is capable of reacting with a carboxy group or a sulfo group such as an epoxy group or an ethyleneimino group, more specifically, acrylic acid, methacrylic acid, N-vinylsulfonylaziridine and glycidyl methacrylate; and in the instance where the reaction does not directly occur between the functional group of the prepolymer and the polymerizable monomer, a cross-linking agent may be used which proceeds with the reaction between the functional group of the prepolymer and that of the polymerizable monomer. As the cross-linking agent, there may be used any compound which has two or more functional groups, at least one of which reacts with a functional group of the prepolymer and the other of which reacts with a functional group of the polymerizable monomer. Examples of the cross-linking agent may be mentioned as follows:

$HOCH_2CH_2OH$,

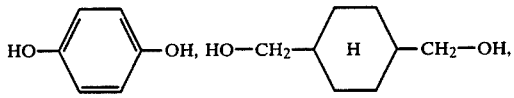

$HOCH_2CH_2OCH_2CH_2OH$, $HSCH_2CH_2OH$, $HSCH_2CH_2SH$, $HOCH_2CH_2COOH$, $HOCH_2COOH$, $HOCH_2CH_2SCH_2COOH$, $HOOCCH_2CH_2COOH$, $HOCOCH{=}CHCOOH$,

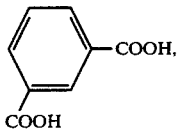

$H_2NCH_2CH_2OH$, $CH_3HNCH_2CH_2OH$, $H_2NCH_2CH_2COOH$, $H_2NCH_2CH_2NH_2$, $H_2NCH_2CH_2NHCH_2CH_2NH_2$,

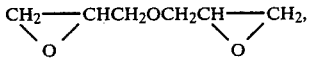

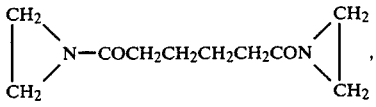

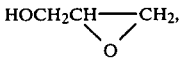

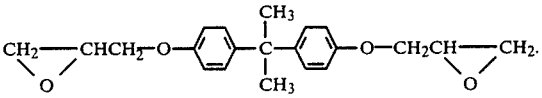

As the preparation method of the toner of the present invention, there may be widely employed a method such as a suspension polymerization method, an emulsion polymerization method, a bulk polymerization method or a solution polymerization method which are the method of a generally used synthetic method for the binder resin of the toner.

The polyolefin component of a modified polyolefin which can be employed as a wax included in the toner according to this invention may be a homopolymer prepared from a single olefin monomer or a copolymer obtained from an olefin monomer and a partner monomer capable of copolymerizing with it.

Examples of the olefin monomers include ethylene, propylene, butene-1, pentene-1, hexene-1, heptene-1, octene-1, nonene-1, decene-1, isomers thereof in which positions of unsaturated bonds are different, 3-methyl-1-butene, 3-methyl-2-pentene and 3-propyl-5-methyl-2-hexene in which branched chains of alkyl groups are included, and other all olefin monomers.

Examples of partner monomers capable of copolymerizing with the olefin monomers include, besides the aforesaid olefin monomers, vinyl ethers such as vinyl methyl ether, vinyl-n-butyl ether and vinyl phenyl ether; vinyl esters such as vinyl acetate and vinyl butyrate; haloolefins such as vinyl fluoride, vinylidene fluoride, tetrafluoroethylene vinyl chloride, vinylidene chloride and tetrachloroethylene; acrylic acid esters or methacrylic acid esters such as methyl acrylate, ethyl acrylate, n-butyl acrylate, methyl methacrylate, ethyl methacrylate, n-butyl methacrylate, stearyl methacrylate, N,N-dimethylaminoethyl methacrylate and t-butylaminoethyl methacrylate; acrylic acid derivatives such as acrylonitrile and N,N-dimethylacrylamide; organic acids such as acrylic acid, methacrylic acid, maleic acid, fumalic acid and itaconic acid; diethyl fumalate; $\beta$-pinene and others.

Therefore, the aforesaid polyolefin component may be an olefin copolymer prepared by copolymerizing two or more olefin monomers mentioned above, and examples of such copolymers include an ethylene-propylene copolymer, ethylene-butene copolymer, ethylene-pentene copolymer, propylene-butene copolymer, propylene-pentene copolymer, ethylene-3-methyl-1-butene copolymer and ethylene-propylene-butene copolymer; or an olefin copolymer prepared by copolymerizing at least one of olefin monomer mentioned above with at least one of olefin monomer other than the mentioned above, and examples of such copolymers include an ethylene-vinyl acetate copolymer, ethylene-vinyl methyl ether copolymer, ethylene-vinyl chloride copolymer, ethylene-methyl acrylate copolymer, ethylene-methyl methacrylate copolymer, ethylene-acrylic acid copolymer, propylene-vinyl acetate copolymer, propylene-vinyl ethyl ether copolymer, propylene-ethyl acrylate copolymer, propylene-methacrylic acid copolymer, butene-methyl methacrylate copolymer, pentene-vinyl acetate copolymer, hexene-vinyl butyrate copolymer, ethylene-propylene-vinyl acetate copolymer and ethylene-vinyl acetate-vinyl methyl ether copolymer.

When the copolymer is formed by using the olefin monomer and a monomer different from the olefin monomer, it is preferred that the copolymer includes 50 mole % or more of the olefin component of the olefin monomer in its polyolefin component, because if the olefin component is included in a smaller proportion, the fixing properties of the toner will not be improved to an enough extent.

The modified polyolefin comprises the polyolefin component and the modified component, and the latter is block polymerized or graft polymerized toward the former.

As the modified components, there may be employed aromatic vinyl monomers, examples of which include 1-phenylpropene, styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and others.

The wax comprising the modified polyolefin can be prepared by block polymerizing or graft polymerizing the aforesaid aromatic vinyl monomer and the already mentioned polyolefin in accordance with a usual procedure and ordinary conditions.

For example, for the block polymerizing, there is utilized a method using a living polymer, a method by reacting the aromatic vinyl monomer with a radical which is produced by dividing mechanical chemically the wax or the like; and for the graft polymerizing, there is utilized a method of reacting the aromatic vinyl monomer with an ozonizated polyethylene, a method of carrying out the graft polymerization by utilizing irradiation light or the like.

An amount of the modified component in the modified polyolefin is preferably within the range of 0.1 to 15% by weight, particularly 1 to 10% by weight. If this amount is too small, the toner will have an extremely low fluidity, and if too great, it will have the elevated minimum fixing temperature.

Further, it is preferred that the modified polyolefin itself has a low softening point. For example, the softening point of the modified polyolefin is within the range of 80° to 180° C., preferably within the range of 90° to 160° C., when measured in accordance with a ring and ball test which is described in JIS K 2531-1960.

The toner according to this invention is a particle material which can be prepared by incorporating by dispersion into the already described binder resin, the wax comprising the aforesaid modified polyolefin, together with a colorant, a magnetic substance, a property improver and other necessary additives, and each particle of the toner usually has an average particle diameter of 5 to 30 microns.

Example of the colorants include carbon black, Nigrosine dye (C.I. No. 50415 B), Aniline Blue (C.I. No. 50405), Calco oil Blue (C.I. No. azoec Blue 3), Chrome Yellow (C.I. No. 14090), Ultramarine Blue (C.I. No. 77103), Du'Pont Oil Red (C.I. No. 26105), Qunolinone Yellow (C.I. No. 47005), Methylene Blue Chloride (C.I. No. 52015), Phthalocyanine Blue (C.I. No. 42000), Lamp Black (C.I. No. 77266), Rose Bengal (C.I. No. 45435), mixtures thereof and others. These colorants are required to be included in the toner in an amount enough to form a visible image having an ample density, and the amount of the colorant is usually within the range of 1 to 20 parts by weight per 100 parts by weight of the binder resin.

Examples of the magnetic substances include ferromagnetic materials such as ferrite, magnetite, iron, cobalt, nickel, alloys thereof and compounds including these elements; alloys which contain no ferromagnetic materials but will show a ferromagnetism by virtue of a proper heat treatment, e.g. Heusler's alloys containing manganese and copper, such as a manganese-copper-aluminum alloy and a manganese-copper-tin alloy; and chromium dioxide. The magnetic substance is uniformly dispersed into the binder in the form of a fine powder, each particle constituting the powder having an average particle diameter of 0.1 to 1 micron. An amount of the magnetic substance to be added is within the range of 20 to 70 parts by weight, preferably 40 to 70 parts by weight per 100 parts by weight of the toner.

The aforesaid property improvers include a charge controlling agent, an offset preventing agent, a fluidity improving lubricant and the like.

The toner according to this invention can be mixed with a carrier comprising an iron powder, glass beads and the like in order to form a two-component developing agent; but the toner containing the magnetic substance can be used intact for the development of the electrostatic charge images, in the form of a one-component developing agent.

The invention will be described in reference to Examples in which no restriction is put on the invention. It is to be noted that "parts" referred to herein represents "parts by weight".

EXPERIMENT 1

Binder resins and waxes used in the undermentioned Examples are as follows:

[BINDER RESINS]

(1) Binder resin A1

A polyester resin including 17% by weight of its chloroform-insoluble content and having a softening point of 131° C. which was prepared as follows: First, 299 g of terephthalic acid, 211 g of polyoxypropylene (2.2)-2,2-bis(4-hydroxyphenyl)propane and 82 g of pentaerythritol were placed in a round flask which was equipped with a thermometer, a stirrer made of glass and a flow system condenser; the round flask was set to a mantle heater; a nitrogen gas was introduced into the round flask through the nitrogen gas inlet pipe to produce an inert atmosphere therein; 0.05 g of dibutyltin oxide was added thereto; and a reaction was then carried out at a temperature of 200° C. while the reaction was pursued at the softening point, in order to prepare the desired polyester resin.

(2) Binder resin A2

A polyester resin including 6% by weight of its chloroform-insoluble content and having a softening point of 125° C. which was prepared as following the same procedure as in the preparation of the binder resin A1 with the exception that an amount of pentaerythritol was 40 g.

(3) Binder resin A3

A polyester resin including 22% by weight of its chloroform-insoluble content and having a softening point of 134° C. which was prepared as following the same procedure as in the preparation of the binder resin A1 with the exception that an amount of pentaerythritol was 100 g.

(4) Binder resin A4

A polyester resin including 17% by weight of its chloroform-insoluble content and having a softening point of 130° C. which was prepared as following the same procedure as in the preparation of the binder resin A1 with the exception that 300 g of triethlene glycol, 182 g of isophthalic acid and 138 g of benzene-1,2,4-tricarboxylic acid were used.

(5) Binder resin C (for comparison)

A polyester resin including 0% by weight of its chloroform-insoluble content and having a softening point of 112° C. which was prepared from an etherified bisphenol A, fumaric acid and terephthalic acid (a ratio of fumaric acid to terephthalic acid was 1:1)..

[WAXES]

(1) Wax A

A polyethylene wax which was block copolymerized with styrene (a content of styrene was 4% by weight and a softening point was 112° C.).

(2) Wax B

A polyethylene wax which was block copolymerized with 1-phenylpropane (a content of 1-phenylpropane was 4% by weight and a softening point was 110° C.).

(3) Wax C

A polyethylene wax which was block copolymerized with styrene (a content of styrene was 8% by weight and a softening point was 116° C.).

(4) Wax D

A polyethylene wax which was graft copolymerized with 1-phenylpropane (a content of 1-phenylpropane was 4% by weight and a softening point was 112° C.).

(5) Wax E (for comparison)

Unmodified polypropylene wax (Viscol 660 P) (produced by Sanyo Kasei Kogyo Co., Ltd.).

(6) Wax F (for comparison)

Unmodified polyethylene wax (High wax 220 P) (having a softening point of 113° C.; produced by Mitsui Petroleum Chemical Co., Ltd.).

(7) Wax G (for comparison)

A oxidizing type polyethylene wax (High wax 4202 E) (having a softening point of 108° C.; produced by Mitsui Petroleum Chemical Co., Ltd.).

In the respective examples and comparative examples, the indicated formula materials were employed in accordance with a usual procedure consisting of melting, kneading, cooling, grinding and classification in order to prepare toners comprising particles each having 10 microns in average particle diameter.

EXAMPLE 1

| | |
|---|---|
| Binder resin A1 | 100 parts |
| Wax A | 3 parts |
| Carbon black "Mogal L" (produced by Cabot Co., Ltd.) | 10 parts |

EXAMPLE 2

| | |
|---|---|
| Binder resin A2 | 100 parts |
| Wax A | 3 parts |
| Carbon black "Mogal L" | 10 parts |

EXAMPLE 3

| | |
|---|---|
| Binder resin A3 | 100 parts |
| Wax A | 3 parts |
| Carbon black "Mogal L" | 10 parts |

EXAMPLE 4

| | |
|---|---|
| Binder resin A1 | 100 parts |
| Wax B | 3 parts |
| Carbon black "Mogal L" | 10 parts |

EXAMPLE 5

| | |
|---|---|
| Binder resin A1 | 100 parts |
| Wax C | 3 parts |
| Carbon black "Mogal L" | 10 parts |

EXAMPLE 6

| | |
|---|---|
| Binder resin A1 | 100 parts |
| Wax D | 3 parts |
| Carbon black "Mogal L" | 10 parts |

EXAMPLE 7

| | |
|---|---|
| Binder resin A1 | 100 parts |
| Wax A | 6 parts |
| Carbon black "Mogal L" | 10 parts |

EXAMPLE 8

| | |
|---|---|
| Binder resin B | 100 parts |
| Wax A | 3 parts |
| Carbon black "Mogal L" | 10 parts |

EXAMPLE 9

| | |
|---|---|
| Binder resin B | 100 parts |
| Wax B | 3 parts |
| Carbon black "Mogal L" | 10 parts |

EXAMPLE 10

| | |
|---|---|
| Binder resin B | 100 parts |
| Wax C | 3 parts |
| Carbon black "Mogal L" | 10 parts |

EXAMPLE 11

| | |
|---|---|
| Binder resin B | 100 parts |
| Wax A | 6 parts |
| Carbon black "Mogal L" | 10 parts |

EXAMPLE 12

| | |
|---|---|
| Binder resin A1 | 48 parts |
| Wax A | 6 parts |
| Magnetic material fine powder "BL-100" (produced by Titanium Kogyo Co., Ltd.) | 52 parts |

COMPARATIVE EXAMPLE 1

| | |
|---|---|
| Binder resin A1 | 100 parts |
| Wax E | 3 parts |
| Carbon black "Mogal L" | 10 parts |

COMPARATIVE EXAMPLE 2

| | |
|---|---|
| Binder resin A1 | 100 parts |
| Wax F | 3 parts |
| Carbon black "Mogal L" | 10 parts |

COMPARATIVE EXAMPLE 3

| | |
|---|---|
| Binder resin A1 | 100 parts |
| Wax G | 3 parts |
| Carbon black "Mogal L" | 10 parts |

COMPARATIVE EXAMPLE 4

| | |
|---|---|
| Binder resin C | 100 parts |
| Wax A | 3 parts |
| Carbon black "Mogal L" | 10 parts |

COMPARATIVE EXAMPLE 5

| | |
|---|---|
| Binder resin A1 | 100 parts |
| Carbon black "Mogal L" | 10 parts |

The respective toners prepared in Examples 1 to 12 will hereinafter be referred to as toner 1 to toner 12, respectively, and the toners formed in Comparative Examples 1 to 5 will be referred to as comparative toner 1 to comparative toner 5, respectively. Fluidity was inspected for the respective toners above. That is to say, on the basis of the fact that the higher the fluidity became, the smaller a compressive degree became; the compressive degrees were measured by the use of a powder compressive degree tester (Tap denser) (manufactured by Seishin Enterprise Co., Ltd.). Concretely, a vessel having a diameter of 28 mm and a volume of 100 ml was charged loosely with each sample from above through a 100-mesh sieve, and its weight was measured to obtain a static bulk density A. After the vessel was closed with a lid having the same diameter, trapping was carried out 600 times on a condition of a drop height being 5 mm by the use of a tapping device, and a volume of the sample was then measured. A compressed bulk density P was calculated by dividing the previously measured weight by this volume, and a compressive degree C was then calculated in accordance with the following equation:

$$C = \frac{P - A}{P} \times 100\ (\%)$$

All the toners of 16 kinds except toner 12 were each mixed with a carrier comprising an iron powder coated with a resin in order to prepare a developing agent in which a toner concentration was 2% by weight and a toner charge amount was 20±1 microcoulomb(μC)/g. For each toner, a development of an electrostatic charge image, a transfer of a toner image to a transfer paper and a fixing of the toner image by means of a hot roller fixing device were carried out by the use of an electrophotographic duplicating machine (U-Bix 3000) (manufactured by Konishiroku Photo Industry Co., Ltd.) in order to measure a primary adhesion amount of the toner on the surface of a light-sensitive drum, a transfer proportion of the toner to the transfer paper and an image density of a duplicated image. The aforementioned primary adhesion amount of the toner can be defined as an adhesion amount of the toner per unit area where a so-called solid black potential is 800 volts.

Further, for each of the toners, its minimum fixing temperature and offset occurring temperature were measured, and the evaluation of its storability was done. The minimum fixing temperature can be defined as the lowest temperature in a temperature range which permits the formation of a fixed image having sufficient wipe-resistant properties, when a fixing operation below is repeated at set temperatures of the heat roller, i.e. at temperatures stepwise raised every 5° C. from 100° C. and the fixed image is subjected to a Kim wiper treatment, the aforesaid fixing operation being accomplished by fixing the toner image of each toner sample transferred to a 64 g/m$^2$ transfer paper at a linear speed of 120 mm/sec with the aid of a fixing device which comprises a hot roller having a surface layer made of Teflon (manufactured by duPont, polytetrafluoroethylene) and a pressure roller having a surface layer made of a silicone rubber (KE-1300 RTV; manufactured by Shinetsu Kagaku Kogyo Co., Ltd.). The fixing device used here had no mechanism for feeding silicone oil.

Further, the offset occurring temperature above was measured by reporting an observation operation below while a set temperature on the hot roller of the aforesaid fixing device was successively elevated, the aforesaid observation operation being accomplished by carrying out a transfer of the toner image and a fixing treatment with the aid of the fixing device in accordance with the procedure of the aforesaid minimum fixing temperature measurement, then feeding the respective white transfer papers to the fixing device under the same conditions, and observing whether or not the papers were soiled with the toner.

The storability above was evaluated on the basis of whether or not any cohesion occurred when each sample was allowed to stand at a temperature of 55° C. at a relative humidity of 40% for 48 hours, and a degree of the cohesion, if occurred.

Results obtained are set forth in Table 1 below.

TABLE 1

| Sample | Compressive degree (%) | Primary adhesion amount (mg/cm$^2$) | Transfer percent (%) | Image density | Minimum fixing temperature (°C.) | Offset occurring temperature (°C.) | Storability |
|---|---|---|---|---|---|---|---|
| Toner 1 | 34.3 | 0.76 | 89 | 1.33 | 160 | 220 | Good |
| Toner 2 | 34.2 | 0.76 | 90 | 1.33 | 155 | 215 | Good |
| Toner 3 | 34.1 | 0.77 | 90 | 1.33 | 160 | 220 | Good |

TABLE 1-continued

| Sample | Compressive degree (%) | Primary adhesion amount (mg/cm$^2$) | Transfer percent (%) | Image density | Minimum fixing temperature (°C.) | Offset occurring temperature (°C.) | Storability |
|---|---|---|---|---|---|---|---|
| Toner 4 | 33.8 | 0.77 | 90 | 1.33 | 160 | 220 | Good |
| Toner 5 | 33.5 | 0.78 | 92 | 1.34 | 160 | 220 | Good |
| Toner 6 | 34.0 | 0.77 | 91 | 1.33 | 160 | 220 | Good |
| Toner 7 | 35.6 | 0.74 | 87 | 1.31 | 150 | 230 | Good |
| Toner 8 | 34.2 | 0.76 | 90 | 1.33 | 160 | 220 | Good |
| Toner 9 | 34.0 | 0.76 | 90 | 1.33 | 160 | 220 | Good |
| Toner 10 | 33.3 | 0.78 | 92 | 1.34 | 160 | 220 | Good |
| Toner 11 | 35.5 | 0.74 | 88 | 1.32 | 150 | 230 | Good |
| Toner 12 | 29.5 | — | — | — | 170 | 230 | Good |
| Comparative Toner 1 | 42.0 | 0.56 | 64 | 1.02 | 180 | 230 | Slightly Good |
| Comparative Toner 2 | 41.5 | 0.57 | 64 | 1.01 | 180 | 220 | Bad |
| Comparative Toner 3 | 37.2 | 0.69 | 80 | 1.19 | 180 | 230 | Slightly Good |
| Comparative Toner 4 | 34.2 | 0.76 | 90 | 1.33 | 140 | 140 | Good |
| Comparative Toner 5 | 33.0 | 0.79 | 92 | 1.34 | 180 | 200 | Good |

Further, continuous duplicating tests were carried out 20,000 times for each of toners 1 to 11 by the use of the electrophotographic duplicating machine (U-Bix 3000), and results of the tests indicated that in the case of every toner, a clear and good image was duplicated to the last, respectively.

EXPERIMENT 2

The undermentioned binder resins and waxes were used, and toners were prepared following the same procedure as in Experiment 1.

[BINDER RESINS]

(1) Binder resin D1

A cross-linked copolymer having a softening point of 134° C. which was prepared by polymerizing a polymerizable composition using 2,2'-azobis-(2,4-dimethylvaleronitrile) as an initiator in accordance with a usual suspension polymerization, the aforesaid polymerizable composition including styrene, n-butyl acrylate and ethylene glycol dimethacrylate in a weight ration of 85:15:0.5.

(2) Binder resin D2

A cross-linked copolymer having a softening point of 138° C. which was prepared by polymerizing a polymerizable composition including styrene, n-butyl acrylate and ethylene glycol dimethacrylate in a weight ration of 85:15:1 in accordance with the same procedure as in the case of binder resin D1.

(3) Binder resin D3

A cross-linked copolymer having a softening point of 135° C. which was prepared by polymerizing a polymerizable composition including styrene, n-butyl acrylate, ethylene glycol dimethacrylate and α-methylstyrene in a weight ration of 85:15:5:7, following the same procedure as in the case of binder resin D1.

(4) Binder resin E

A cross-linked copolymer having a softening point of 135° C. which was prepared by polymerizing a polymerizable composition using 2,2'-azobis-(2,4-dimethylvaleronitrile) as an initiator in accordance with a usual suspension polymerization, the aforesaid polymerizable composition including styrene, n-butyl acrylate and trimethylolpropane triacrylate in a weight ration of 85:15:1.

(5) Binder resin F (for comparison)

A non-cross-linked copolymer having a softening point of 115° C. which was prepared following the same procedure as in the case of binder resin D1 with the exception that ethylene glycol dimethacrylate was omitted from the polymerizable composition of binder resin D1.

[WAXES]

The same waxes A to G as in Experiment 1 were employed.

In the respective examples and comparative examples, the indicated formula materials were employed in accordance with a usual procedure consisting of melting, kneading, cooling, grinding and classification in the same manner as in Experiment 1 in order to prepare toners comprising particles each having 10 microns in average particle diameter.

EXAMPLE 13

| | |
|---|---|
| Binder resin D1 | 100 parts |
| Wax A | 3 parts |
| Carbon black "Mogal L" (produced by Cabot Co., Ltd.) | 10 parts |

EXAMPLE 14

| | |
|---|---|
| Binder resin D2 | 100 parts |
| Wax A | 3 parts |
| Carbon black "Mogal L" | 10 parts |

EXAMPLE 15

| | |
|---|---|
| Binder resin D3 | 100 parts |
| Wax A | 3 parts |
| Carbon black "Mogal L" | 10 parts |

EXAMPLE 16

| | |
|---|---|
| Binder resin D1 | 100 parts |
| Wax B | 3 parts |
| Carbon black "Mogal L" | 10 parts |

EXAMPLE 17

| | |
|---|---|
| Binder resin D1 | 100 parts |
| Wax C | 3 parts |
| Carbon black "Mogal L" | 10 parts |

EXAMPLE 18

| | |
|---|---|
| Binder resin D1 | 100 parts |
| Wax D | 3 parts |
| Carbon black "Mogal L" | 10 parts |

EXAMPLE 19

| | |
|---|---|
| Binder resin D1 | 100 parts |
| Wax A | 6 parts |
| Carbon black "Mogal L" | 10 parts |

EXAMPLE 20

| | |
|---|---|
| Binder resin E | 100 parts |
| Wax A | 3 parts |
| Carbon black "Mogal L" | 10 parts |

EXAMPLE 21

| | |
|---|---|
| Binder resin E | 100 parts |
| Wax B | 3 parts |
| Carbon black "Mogal L" | 10 parts |

EXAMPLE 22

| | |
|---|---|
| Binder resin E | 100 parts |
| Wax C | 3 parts |
| Carbon black "Mogal L" | 10 parts |

EXAMPLE 23

| | |
|---|---|
| Binder resin E | 100 parts |
| Wax A | 6 parts |
| Carbon black "Mogal L" | 10 parts |

EXAMPLE 24

| | |
|---|---|
| Binder resin D1 | 48 parts |
| Wax A | 3 parts |
| Magnetic material fine powder "BL-100" (produced by Titanium Kogyo Co., Ltd.) | 52 parts |

COMPARATIVE EXAMPLE 6

| | |
|---|---|
| Binder resin D1 | 100 parts |
| Wax E | 3 parts |
| Carbon black "Mogal L" | 10 parts |

COMPARATIVE EXAMPLE 7

| | |
|---|---|
| Binder resin D1 | 100 parts |
| Wax F | 3 parts |
| Carbon black "Mogal L" | 10 parts |

COMPARATIVE EXAMPLE 8

| | |
|---|---|
| Binder resin D1 | 100 parts |
| Wax G | 3 parts |
| Carbon black "Mogal L" | 10 parts |

COMPARATIVE EXAMPLE 9

| | |
|---|---|
| Binder resin F | 100 parts |
| Wax A | 3 parts |
| Carbon black "Mogal L" | 10 parts |

COMPARATIVE EXAMPLE 10

| | |
|---|---|
| Binder resin D1 | 100 parts |
| Carbon black "Mogal L" | 10 parts |

The respective toners prepared in Examples 13 to 24 will hereinafter be referred to as toner 13 to toner 24, respectively, and the toners formed in Comparative Examples 6 to 10 will be referred to as comparative toner 6 to comparative toner 10, respectively. Fluidity was inspected for the respective toners above in the same manner as in Experiment 1.

Further, for each of all the toners, its minimum fixing temperature and offset occurring temperature were measured, and the evaluation of its storability was done in the same manner as in Experiment 1.

Results obtained are set forth in Table 2 below.

TABLE 2

| Sample | Compressive degree (%) | Primary adhesion amount (mg/cm$^2$) | Transfer percent (%) | Image density | Minimum fixing temperature (°C.) | Offset occurring temperature (°C.) | Storability |
|---|---|---|---|---|---|---|---|
| Toner 13 | 33.9 | 0.73 | 91 | 1.33 | 160 | 220 | Good |
| Toner 14 | 34.0 | 0.73 | 91 | 1.33 | 165 | 225 | Good |
| Toner 15 | 33.8 | 0.74 | 92 | 1.34 | 160 | 220 | Good |
| Toner 16 | 33.2 | 0.74 | 91 | 1.33 | 160 | 220 | Good |
| Toner 17 | 33.0 | 0.74 | 91 | 1.34 | 160 | 220 | Good |

TABLE 2-continued

| Sample | Compressive degree (%) | Primary adhesion amount (mg/cm$^2$) | Transfer percent (%) | Image density | Minimum fixing temperature (°C.) | Offset occurring temperature (°C.) | Storability |
|---|---|---|---|---|---|---|---|
| Toner 18 | 33.8 | 0.73 | 91 | 1.34 | 160 | 220 | Good |
| Toner 19 | 35.6 | 0.70 | 88 | 1.30 | 150 | 230 | Good |
| Toner 20 | 33.8 | 0.73 | 90 | 1.32 | 160 | 220 | Good |
| Toner 21 | 33.0 | 0.75 | 92 | 1.34 | 160 | 220 | Good |
| Toner 22 | 32.6 | 0.76 | 92 | 1.34 | 160 | 220 | Good |
| Toner 23 | 35.5 | 0.71 | 88 | 1.31 | 150 | 230 | Good |
| Toner 24 | 28.6 | — | — | — | 170 | 230 | Good |
| Comparative Toner 6 | 41.4 | 0.55 | 66 | 1.02 | 180 | 230 | Slightly Good |
| Comparative Toner 7 | 41.3 | 0.55 | 65 | 1.01 | 180 | 220 | Bad |
| Comparative Toner 8 | 37.2 | 0.67 | 81 | 1.19 | 180 | 220 | Slightly Good |
| Comparative Toner 9 | 34.0 | 0.73 | 91 | 1.32 | 140 | 140 | Good |
| Comparative Toner 10 | 32.6 | 0.76 | 92 | 1.34 | 180 | 200 | Good |

Further, continuous duplicating tests were carried out 20,000 times for each of toners 13 to 23 by the use of the electrophotographic duplicating machine (U-Bix 3000), and results of the tests indicated that in the case of every toner, a clear and good image was duplicated to the last, respectively.

EXPERIMENT 3

The undermentioned binder resins and waxes were used, and toners were prepared following the same procedure as in Experiment 1.

[BINDER RESINS]

(1) Binder resin G1

| | |
|---|---|
| (Dispersion medium) | |
| Water | 180 parts |
| (Monomers) | |
| Butadiene | 10 parts |
| Styrene | 90 parts |
| Divinyl benzene | 0.16 part |
| (Emulsifiers) | |
| Fatty acid potassium salt | 2.2 parts |
| Ununiformed rosin acid potassium salt | 2.2 parts |
| Potassium phosphate | 0.4 part |
| (Polymerization initiators) | |
| Ferrous sulfate | 0.005 part |
| Paramenthane hydroperoxide | 0.02 part |
| t-Dodecyl mercaptan | 0.5 part |

An S-B copolymer including 41% by weight of a high molecular weight component a molecular weight of which is 100,000 or more and having a softening point of 141° C., the S-B copolymer being prepared by first placing a mixture of the aforesaid formulation in a 20 liter autoclave in which its interior is replaced by a nitrogen gas; carrying out a polymerization reaction at a temperature of 5° C.; adding thereto 0.2 part of N,N'-diethylhydroxylamine as a polymerization initiator when a degree of its conversion reached a level of 70%, in order to cause the reaction to stop; adding 1 part of a stabilizer to the resulting latex; introducing thereinto calcium chloride as a coagulant to coagulate the polymer; and carrying out dehydration and drying.

(2) Binder resin G2

An S-B copolymer including 19% by weight of a high molecular weight component a molecular weight of which is 100,000 or more and having a softening point of 130° C., the S-B copolymer being prepared following the same procedure as in the manufacture of the binder resin G1 with the exception that an amount of divinylbenzene was 0.16 part and an amount of t-dodecyl mercaptan was 0.8 part.

(3) Binder resin G3

An S-B copolymer including 63% by weight of a high molecular weight component a molecular weight of which is 100,000 or more and having a softening point of 146° C., the S-B copolymer being prepared following the same procedure as in the manufacture of the binder resin G1 with the exception that an amount of divinylbenzene was 0.16 part and an amount of t-dodecyl mercaptan was 0.3 part.

(4) Binder resin H

An S-B copolymer including 28% by weight of a high molecular weight component a molecular weight of which is 100,000 or more and having a softening point of 132° C., the S-B copolymer being prepared by first mixing latex A with latex B in such a proportion that a ratio of latex A to latex B is 2:1; and then treating the resulting latex mixture in the same manner as in the case of the binder resin G1, the aforesaid latex A being a low molecular weight resin which was prepared following the same procedure as in the manufacture of the binder resin G1 with the exception that an amount of divinylbenzene was 0.16 part and an amount of t-dodecyl mercaptan was 1.3 parts, the aforesaid latex B being a high molecular weight resin which was prepared following the same procedure as in the manufacture of the binder resin G1 with the exception that an amount of divinylbenzene was 0.16 part and an amount of t-dodecyl mercaptan was 0.4 part.

(5) Binder resin I (for comparison)

An S-B copolymer including 8% by weight of a high molecular weight component a molecular weight of which is 100,000 or more and having a softening point of 125° C., the S-B copolymer being prepared following the same procedure as in the manufacture of the binder resin G1 with the exception that an amount of divinylbenzene was 0.08 part and an amount of t-dodecyl mercaptan was 1.3 parts.

[WAXES]

The same waxes A to G as in Experiment 1 were employed.

In the respective examples and comparative examples, the indicated formula materials were employed in accordance with a usual procedure consisting of melting, kneading, cooling, grinding and classification in the same manner as in Experiment 1 in order to prepare toners comprising particles each having 10 microns in average particle diameter.

EXAMPLE 25

| | |
|---|---|
| Binder resin G1 | 100 parts |
| Wax A | 3 parts |
| Carbon black "Mogal L" (produced by Cabot Co., Ltd.) | 10 parts |

EXAMPLE 26

| | |
|---|---|
| Binder resin G2 | 100 parts |
| Wax A | 3 parts |
| Carbon black "Mogal L" | 10 parts |

EXAMPLE 27

| | |
|---|---|
| Binder resin G3 | 100 parts |
| Wax A | 3 parts |
| Carbon black "Mogal L" | 10 parts |

EXAMPLE 28

| | |
|---|---|
| Binder resin G1 | 100 parts |
| Wax B | 3 parts |
| Carbon black "Mogal L" | 10 parts |

EXAMPLE 29

| | |
|---|---|
| Binder resin G1 | 100 parts |
| Wax C | 3 parts |
| Carbon black "Mogal L" | 10 parts |

EXAMPLE 30

| | |
|---|---|
| Binder resin G1 | 100 parts |
| Wax D | 3 parts |
| Carbon black "Mogal L" | 10 parts |

EXAMPLE 31

| | |
|---|---|
| Binder resin G1 | 100 parts |
| Wax A | 6 parts |
| Carbon black "Mogal L" | 10 parts |

EXAMPLE 32

| | |
|---|---|
| Binder resin H | 100 parts |
| Wax A | 3 parts |

-continued

| | |
|---|---|
| Carbon black "Mogal L" | 10 parts |

EXAMPLE 33

| | |
|---|---|
| Binder resin H | 100 parts |
| Wax B | 3 parts |
| Carbon black "Mogal L" | 10 parts |

EXAMPLE 34

| | |
|---|---|
| Binder resin H | 100 parts |
| Wax C | 3 parts |
| Carbon black "Mogal L" | 10 parts |

EXAMPLE 35

| | |
|---|---|
| Binder resin H | 100 parts |
| Wax A | 6 parts |
| Carbon black "Mogal L" | 10 parts |

EXAMPLE 36

| | |
|---|---|
| Binder resin G1 | 48 parts |
| Wax A | 3 parts |
| Magnetic material fine powder "BL-100" (produced by Titanium Kogyo Co., Ltd.) | 52 parts |

COMPARATIVE EXAMPLE 11

| | |
|---|---|
| Binder resin G1 | 100 parts |
| Wax E | 3 parts |
| Carbon black "Mogal L" | 10 parts |

COMPARATIVE EXAMPLE 12

| | |
|---|---|
| Binder resin G1 | 100 parts |
| Wax F | 3 parts |
| Carbon black "Mogal L" | 10 parts |

COMPARATIVE EXAMPLE 13

| | |
|---|---|
| Binder resin G1 | 100 parts |
| Wax G | 3 parts |
| Carbon black "Mogal L" | 10 parts |

COMPARATIVE EXAMPLE 14

| | |
|---|---|
| Binder resin I | 100 parts |
| Wax A | 3 parts |
| Carbon black "Mogal L" | 10 parts |

COMPARATIVE EXAMPLE 15

| | |
|---|---|
| Binder resin G1 | 100 parts |

-continued

| | |
|---|---|
| Carbon black "Mogal L" | 10 parts |

The respective toners prepared in Examples 25 to 36 will hereinafter be referred to as toner 25 to toner 36, respectively, and the toners formed in Comparative Examples 11 to 15 will be referred to as comparative toner 11 to comparative toner 15, respectively. Fluidity was inspected for the respective toners above in the same manner as in Experiment 1.

Further, for each of all the toners, its minimum fixing temperature and offset occurring temperature were measured, and the evaluation of its storability was done in the same manner as in Experiment 1.

Results obtained are set forth in Table 3 below.

TABLE 3

| Sample | Compressive degree (%) | Primary adhesion amount (mg/cm$^2$) | Transfer percent (%) | Image density | Minimum fixing temperature (°C.) | Offset occurring temperature (°C.) | Storability |
|---|---|---|---|---|---|---|---|
| Toner 25 | 34.1 | 0.74 | 90 | 1.32 | 165 | 225 | Good |
| Toner 26 | 34.0 | 0.73 | 90 | 1.33 | 160 | 220 | Good |
| Toner 27 | 34.0 | 0.74 | 91 | 1.33 | 170 | 230 | Good |
| Toner 28 | 33.8 | 0.74 | 91 | 1.33 | 165 | 225 | Good |
| Toner 29 | 33.0 | 0.77 | 92 | 1.34 | 165 | 225 | Good |
| Toner 30 | 34.1 | 0.73 | 90 | 1.33 | 165 | 225 | Good |
| Toner 31 | 35.5 | 0.71 | 88 | 1.31 | 155 | 235 | Good |
| Toner 32 | 34.0 | 0.74 | 91 | 1.32 | 160 | 220 | Good |
| Toner 33 | 33.6 | 0.74 | 91 | 1.33 | 160 | 220 | Good |
| Toner 34 | 32.8 | 0.77 | 92 | 1.34 | 160 | 220 | Good |
| Toner 35 | 35.7 | 0.70 | 88 | 1.30 | 150 | 230 | Good |
| Toner 36 | 28.8 | — | — | — | 170 | 235 | Good |
| Comparative Toner 11 | 41.2 | 0.56 | 65 | 1.01 | 185 | 235 | Slightly Good |
| Comparative Toner 12 | 41.3 | 0.56 | 64 | 1.00 | 185 | 225 | Bad |
| Comparative Toner 13 | 37.2 | 0.66 | 80 | 1.20 | 185 | 225 | Slightly Good |
| Comparative Toner 14 | 34.0 | 0.74 | 91 | 1.33 | 150 | 175 | Good |
| Comparative Toner 15 | 32.7 | 0.77 | 92 | 1.34 | 185 | 205 | Good |

Further, continuous duplicating tests were carried out 20,000 times for each of toners 25 to 35 by the use of the electrophotographic duplicating machine (U-Bix 3000), and results of the tests indicated that in the case of every toner, a clear and good image was duplicated to the last, respectively.

EXPERIMENT 4

The undermentioned binder resins and waxes were used, and toners were prepared following the same procedure as in Experiment 1.

[BINDER RESINS]

(1) Binder resin J1

A copolymer including a high molecular weight component in a weight ratio of 40:100, and having Mw=130,000, Mn=8,000 and Mw/Mn=16.25 as well as a softening point of 135° C., the copolymer being prepared by copolymerizing styrene, methyl methacrylate and n-butyl methacrylate in a weight ratio of 50:20:30.

(2) Binder resin J2

A copolymer having Mw=100,000, Mn=8,000 and Mw/Mn=12.5 as well as a softening point of 132° C. which was prepared following the same procedure as in the case of the binder resin J1.

(3) Binder resin J3

A copolymer having Mw=95,000, Mn=11,000 and Mw/Mn=8.6 as well as a softening point of 134° C. which was prepared following the same procedure as in the case of the binder resin J1.

(4) Binder resin K

A copolymer having Mw=80,000, Mn=15,000 and Mw/Mn=5.3 as well as a softening point of 136° C. which was prepared by copolymerizing styrene and n-butyl acrylate in a weight ratio of 85:15.

(5) Binder resin L (for comparison)

A copolymer having Mw=50,000, Mn=25,000 and Mw/Mn=2.0 as well as a softening point of 135° C. which was prepared following the same procedure as in the case of the binder resin J1.

[WAXES]

The same waxes A to G as in Experiment 1 were employed.

In the respective examples and comparative examples, the indicated formula materials were employed in accordance with a usual procedure consisting of melting, kneading, cooling, grinding and classification in the same manner as in Experiment 1 in order to prepare toners comprising particles each having 10 microns in average particle diameter.

EXAMPLE 37

| | |
|---|---|
| Binder resin J1 | 100 parts |
| Wax A | 3 parts |
| Carbon black "Mogal L" (produced by Cabot Co., Ltd.) | 10 parts |

EXAMPLE 38

| | |
|---|---|
| Binder resin J2 | 100 parts |
| Wax A | 3 parts |

-continued

| | |
|---|---|
| Carbon black "Mogal L" | 10 parts |

EXAMPLE 39

| | |
|---|---|
| Binder resin J3 | 100 parts |
| Wax A | 3 parts |
| Carbon black "Mogal L" | 10 parts |

EXAMPLE 40

| | |
|---|---|
| Binder resin J1 | 100 parts |
| Wax B | 3 parts |
| Carbon black "Mogal L" | 10 parts |

EXAMPLE 41

| | |
|---|---|
| Binder resin J1 | 100 parts |
| Wax C | 3 parts |
| Carbon black "Mogal L" | 10 parts |

EXAMPLE 42

| | |
|---|---|
| Binder resin J1 | 100 parts |
| Wax D | 3 parts |
| Carbon black "Mogal L" | 10 parts |

EXAMPLE 43

| | |
|---|---|
| Binder resin J1 | 100 parts |
| Wax A | 6 parts |
| Carbon black "Mogal L" | 10 parts |

EXAMPLE 44

| | |
|---|---|
| Binder resin K | 100 parts |
| Wax A | 3 parts |
| Carbon black "Mogal L" | 10 parts |

EXAMPLE 45

| | |
|---|---|
| Binder resin K | 100 parts |
| Wax B | 3 parts |
| Carbon black "Mogal L" | 10 parts |

EXAMPLE 46

| | |
|---|---|
| Binder resin K | 100 parts |
| Wax C | 3 parts |
| Carbon black "Mogal L" | 10 parts |

EXAMPLE 47

| | |
|---|---|
| Binder resin K | 100 parts |
| Wax A | 6 parts |
| Carbon black "Mogal L" | 10 parts |

EXAMPLE 48

| | |
|---|---|
| Binder resin J1 | 48 parts |
| Wax A | 3 parts |
| Magnetic material fine powder "BL-100" (produced by Titanium Kogyo Co., Ltd.) | 52 parts |

COMPARATIVE EXAMPLE 16

| | |
|---|---|
| Binder resin J1 | 100 parts |
| Wax E | 3 parts |
| Carbon black "Mogal L" | 10 parts |

COMPARATIVE EXAMPLE 17

| | |
|---|---|
| Binder resin J1 | 100 parts |
| Wax F | 3 parts |
| Carbon black "Mogal L" | 10 parts |

COMPARATIVE EXAMPLE 18

| | |
|---|---|
| Binder resin J1 | 100 parts |
| Wax G | 3 parts |
| Carbon black "Mogal L" | 10 parts |

COMPARATIVE EXAMPLE 19

| | |
|---|---|
| Binder resin L | 100 parts |
| Wax A | 3 parts |
| Carbon black "Mogal L" | 10 parts |

COMPARATIVE EXAMPLE 20

| | |
|---|---|
| Binder resin J1 | 100 parts |
| Carbon black "Mogal L" | 10 parts |

The respective toners prepared in Examples 37 to 48 will hereinafter be referred to as toner 37 to toner 48, respectively, and the toners formed in Comparative Examples 16 to 20 will be referred to as comparative toner 16 to comparative toner 20, respectively. Fluidity was inspected for the respective toners above in the same manner as in Experiment 1.

Further, for each of all the toners, its minimum fixing temperature and offset occurring temperature were measured, and the evaluation of its storability was done in the same manner as in Experiment 1.

Results obtained are set forth in Table 4 below.

TABLE 4

| Sample | Compressive degree (%) | Primary adhesion amount (mg/cm²) | Transfer percent (%) | Image density | Minimum fixing temperature (°C.) | Offset occurring temperature (°C.) | Storability |
|---|---|---|---|---|---|---|---|
| Toner 37 | 34.0 | 0.72 | 90 | 1.33 | 160 | 220 | Good |
| Toner 38 | 33.8 | 0.72 | 91 | 1.33 | 160 | 220 | Good |
| Toner 39 | 34.1 | 0.72 | 90 | 1.33 | 160 | 220 | Good |
| Toner 40 | 33.0 | 0.74 | 91 | 1.34 | 160 | 220 | Good |
| Toner 41 | 33.0 | 0.75 | 92 | 1.34 | 160 | 220 | Good |
| Toner 42 | 33.8 | 0.73 | 91 | 1.34 | 160 | 220 | Good |
| Toner 43 | 35.5 | 0.71 | 88 | 1.31 | 150 | 230 | Good |
| Toner 44 | 33.8 | 0.73 | 91 | 1.33 | 160 | 220 | Good |
| Toner 45 | 33.2 | 0.73 | 91 | 1.33 | 160 | 220 | Good |
| Toner 46 | 32.8 | 0.75 | 92 | 1.34 | 160 | 220 | Good |
| Toner 47 | 35.0 | 0.71 | 89 | 1.31 | 150 | 230 | Good |
| Toner 48 | 28.5 | — | — | — | 170 | 230 | Good |
| Comparative Toner 16 | 41.5 | 0.56 | 65 | 1.01 | 180 | 230 | Slightly Good |
| Comparative Toner 17 | 41.2 | 0.55 | 65 | 1.00 | 180 | 220 | Bad |
| Comparative Toner 18 | 37.0 | 0.67 | 81 | 1.18 | 180 | 220 | Slightly Good |
| Comparative Toner 19 | 34.0 | 0.73 | 91 | 1.33 | 160 | 200 | Good |
| Comparative Toner 20 | 32.5 | 0.76 | 92 | 1.34 | 180 | 200 | Good |

Further, continuous duplicating tests were carried out 20,000 times for each of toners 37 to 47 by the use of the electrophotographic duplicating machine (U-Bix 3000), and results of the tests indicated that in the case of every toner, a clear and good image was duplicated to the last, respectively.

EXPERIMENT 5

The undermentioned binder resins and waxes were used, and toners were prepared following the same procedure as in Experiment 1.

[BINDER RESINS]

(1) Binder resin M

| | | |
|---|---|---|
| Polymerizable monomers: | Styrene | 85 parts |
| | n-Butyl acrylate | 15 parts |
| Reactive prepolymer: | | 3 parts |

(An unsaturated polyester resin having a softening point of 112° C. which was prepared by reacting etherificated bisphenol A with fumalic acid and terephthalic acid having weight ratio of 1:1.)

A resin having a softening point of 130° C. which was prepared by polymerizing the substance mentioned above using benzoyl peroxide as an initiator.

(2) Binder resin N

| | | |
|---|---|---|
| Polymerizable monomers: | Styrene | 85 parts |
| | n-Butyl acrylate | 15 parts |
| Reactive prepolymer: | | 5 parts |
| α,α-polybutadiene glycol "NISSO-PB-G-3000" (produced by Nippon Soda Co., Ltd.; molecular weight: 3,000) | | |

A resin having a softening point of 132° C. which was prepared by polymerizing the substance mentioned above using benzoyl peroxide as an initiator.

(3) Binder resin O (for comparison)

| | | |
|---|---|---|
| Polymerizable monomers: | Styrene | 85 parts |

-continued

| | | |
|---|---|---|
| | n-Butyl acrylate | 15 parts |

A resin having a softening point of 120° C. which was prepared by polymerizing the substance mentioned above using benzoyl peroxide as an initiator.

[WAXES]

The same waxes A to G as in Experiment 1 were employed.

In the respective examples and comparative examples, the indicated formula materials were employed in accordance with a usual procedure consisting of melting, kneading, cooling, grinding and classification in the same manner as in Experiment 1 in order to prepare toners comprising particles each having 10 microns in average particle diameter.

EXAMPLE 49

| | |
|---|---|
| Binder resin M | 100 parts |
| Wax A | 3 parts |
| Carbon black "Mogal L" (produced by Cabot Co., Ltd.) | 10 parts |

EXAMPLE 50

| | |
|---|---|
| Binder resin M | 100 parts |
| Wax B | 3 parts |
| Carbon black "Mogal L" | 10 parts |

EXAMPLE 51

| | |
|---|---|
| Binder resin M | 100 parts |
| Wax C | 3 parts |
| Carbon black "Mogal L" | 10 parts |

EXAMPLE 52

| | |
|---|---|
| Binder resin M | 100 parts |
| Wax D | 3 parts |
| Carbon black "Mogal L" | 10 parts |

EXAMPLE 53

| | |
|---|---|
| Binder resin M | 100 parts |
| Wax A | 6 parts |
| Carbon black "Mogal L" | 10 parts |

EXAMPLE 54

| | |
|---|---|
| Binder resin N | 100 parts |
| Wax A | 3 parts |
| Carbon black "Mogal L" | 10 parts |

EXAMPLE 55

| | |
|---|---|
| Binder resin N | 100 parts |
| Wax B | 3 parts |
| Carbon black "Mogal L" | 10 parts |

EXAMPLE 56

| | |
|---|---|
| Binder resin N | 100 parts |
| Wax C | 3 parts |
| Carbon black "Mogal L" | 10 parts |

EXAMPLE 57

| | |
|---|---|
| Binder resin N | 100 parts |
| Wax A | 6 parts |
| Carbon black "Mogal L" | 10 parts |

EXAMPLE 58

| | |
|---|---|
| Binder resin M | 48 parts |
| Wax A | 3 parts |
| Magnetic material fine powder | 52 parts |

-continued

| | |
|---|---|
| "BL-100" (produced by Titanium Kogyo Co., Ltd.) | |

COMPARATIVE EXAMPLE 21

| | |
|---|---|
| Binder resin M | 100 parts |
| Wax E | 3 parts |
| Carbon black "Mogal L" | 10 parts |

COMPARATIVE EXAMPLE 22

| | |
|---|---|
| Binder resin M | 100 parts |
| Wax F | 3 parts |
| Carbon black "Mogal L" | 10 parts |

COMPARATIVE EXAMPLE 23

| | |
|---|---|
| Binder resin M | 100 parts |
| Wax G | 3 parts |
| Carbon black "Mogal L" | 10 parts |

COMPARATIVE EXAMPLE 24

| | |
|---|---|
| Binder resin O | 100 parts |
| Wax A | 3 parts |
| Carbon black "Mogal L" | 10 parts |

COMPARATIVE EXAMPLE 25

| | |
|---|---|
| Binder resin M | 100 parts |
| Carbon black "Mogal L" | 10 parts |

The respective toners prepared in Examples 49to 58 will hereinafter be referred to as toner 49 to toner 58, respectively, and the toners formed in Comparative Examples 21 to 25 will be referred to as comparative toner 21 to comparative toner 25, respectively. Fluidity was inspected for the respective toners above in the same manner as in Experiment 1.

Further, for each of all the toners, its minimum fixing temperature and offset occurring temperature were measured, and the evaluation of its storability was done in the same manner as in Experiment 1.

Results obtained are set forth in Table 5 below.

TABLE 5

| Sample | Compressive degree (%) | Primary adhesion amount (mg/cm$^2$) | Transfer percent (%) | Image density | Minimum fixing temperature (°C.) | Offset occurring temperature (°C.) | Storability |
|---|---|---|---|---|---|---|---|
| Toner 49 | 34.2 | 0.71 | 91 | 1.32 | 160 | 220 | Good |
| Toner 50 | 34.0 | 0.72 | 92 | 1.32 | 160 | 220 | Good |
| Toner 51 | 33.1 | 0.74 | 93 | 1.34 | 160 | 220 | Good |
| Toner 52 | 33.9 | 0.72 | 92 | 1.33 | 160 | 220 | Good |
| Toner 53 | 35.4 | 0.70 | 90 | 1.31 | 150 | 230 | Good |
| Toner 54 | 34.1 | 0.71 | 91 | 1.32 | 160 | 220 | Good |
| Toner 55 | 34.0 | 0.72 | 92 | 1.32 | 160 | 220 | Good |
| Toner 56 | 33.0 | 0.74 | 93 | 1.33 | 160 | 220 | Good |
| Toner 57 | 35.3 | 0.70 | 90 | 1.31 | 150 | 230 | Good |
| Toner 58 | 28.5 | — | — | — | 170 | 230 | Good |
| Comparative Toner 21 | 41.5 | 0.56 | 65 | 1.01 | 180 | 230 | Slightly Good |
| Comparative Toner 22 | 41.3 | 0.57 | 65 | 1.01 | 180 | 220 | Bad |

TABLE 5-continued

| Sample | Compressive degree (%) | Primary adhesion amount (mg/cm$^2$) | Transfer percent (%) | Image density | Minimum fixing temperature (°C.) | Offset occurring temperature (°C.) | Storability |
|---|---|---|---|---|---|---|---|
| Comparative Toner 23 | 37.0 | 0.67 | 81 | 1.20 | 180 | 220 | Slightly Good |
| Comparative Toner 24 | 34.2 | 0.72 | 92 | 1.32 | 150 | 150 | Good |
| Comparative Toner 25 | 32.6 | 0.76 | 93 | 1.34 | 180 | 200 | Good |

Further, continuous duplicating tests were carried out 20,000 times for each of toners 49 to 57 by the use of the electrophotographic duplicating machine (U-Bix 3000), and results of the tests indicated that in the case of every toner, a clear and good image was duplicated to the last, respectively.

As is clear from the above-mentioned results, the toner according to this invention has excellent non-offset properties and a very low minimum fixing temperature; therefore, the fixable temperature range of the toner is more extensive as compared with a conventional toner including an unmodified polyolefin wax or the like. In addition, the fluidity of the toner according to this invention is high, therefore it can sufficiently be utilized without requiring an addition of any fluidity improver. Moreover, the toner according to this invention is also excellent in developing and transfer properties, and so it always permits the stable formation of good visible images.

We claim:

1. A toner particle for development of electrostatic images, characterized by including (1) a binder resin selected from the group consisting of a polyester resin containing 5% by weight or more of its chloroform-insoluble content;

a polymer of a vinyl monomer containing 0.005% by weight or more of a cross-linking agent monomer with respect to the total monomers;

a styrene-butadiene copolymer containing 10% by weight or more of a high molecular weight component having a molecular weight of 100,000 or more;

a polymer of a styrene monomer or a copolymer of the styrene monomer and another vinyl monomer, a ratio of its weight average molecular weight Mw with respect to its number average molecular weight Mn being 3.5 or more; and a polymer formed by polymerization of a polymerizable monomer in the presence of a reactive prepolymer;

(2) a wax comprising a polyolefin which has been block copolymerized or graft copolymerized with an aromatic vinyl monomer wherein the content of said wax is within the range of 1 to 20% by weight; and (3) a colorant.

2. A toner for development of electrostatic images according to claim 1, wherein the content of said wax is within the range of 1 to 10% by weight.

3. A toner for development of electrostatic images according to claim 1, wherein the polyester resin is present and said polyester resin is prepared by a condensation polymerization of an alcohol and a carboxylic acid.

4. A toner for development of electrostatic images according to claim 3, wherein the alcohol is selected from the group consisting of diol, 1,4-bis-(hydroxymethyl)cyclohexane, etherificated bisphenols, divalent alcohols and multifunctional alcohols, and the carboxylic acid is selected from the group consisting of divalent carboxylic acids, divalent organic acid monomers and multifunctional carboxylic acid monomers.

5. A toner for development of electrostatic images according to claim 4, wherein the multifunctional carboxylic acid monomers is present in a proportion of 30 to 80 mole % of the alcohol component or the acid component as a structural unit in the polyester resin.

6. A toner for development of electrostatic images according to claim 3, wherein the polyester resin has a molecular weight of 200,000 or more.

7. A toner for development of electrostatic images according to claim 1, wherein the vinyl monomer is present and said vinyl monomer is selected from the group consisting of styrene monomers, ethylenic unsaturated monoolefins, halogenated vinyl monomers, vinyl esters, α-methylene aliphatic monocarboxylic acid esters, acrylic acid derivatives, methacrylic acid derivatives, vinyl ethers, vinyl ketones, N-vinyl compounds and vinyl naphthalenes.

8. A toner for development of electrostatic images according to claim 7, wherein the cross-linking agent monomer is a compound having two or more polymeric double bonds.

9. A toner for development of electrostatic images according to claim 8, wherein the cross-linking agent monomer is selected from the group consisting of aromatic divinyl compounds, diethylenic carboxylic acid esters, N,N-divinyl anilides, divinyl ethers, divinyl sulfides, divnyl sulfones and a compound having three or more vinyl groups.

10. A toner for development of electrostatic images according to claim 8, wherein the cross-linking agent monomer is contained in the range of 0.005 to 20% by weight based on the whole monomers.

11. A toner for development of electrostatic images according to claim 10, wherein the cross-linking agent monomer is contained in the range of 0.1 to 5% by weight based on the whole monomers.

12. A toner for development of electrostatic images according to claim 1, wherein the styrene-butadiene copolymer is present and said styrene-butadiene copolymer is prepared by copolymerizing styrene monomers selected from the group consisting of styrene, o-methylstyrene, m-methylstyrene, p-methylstyrene, α-methylstyrene, p-ethylstyrene, 2,4-dimethylstyrene, p-n-butylstyrene, p-n-dodecylstyrene, p-methoxystyrene, p-phenylstyrene and p-chlorostyrene with butadiene.

13. A toner for development of electrostatic images according to claim 12, wherein the high molecular components having the molecular weight of 100,000 or more of the styrene-butadiene copolymer is present in the proportion of 10 to 70% by weight.

14. A toner for development of electrostatic images according to claim 12, wherein the styrene component in the styrene-butadiene copolymer is present in the range of 70 to 98% by weight based on the total monomer.

15. A toner for development of electrostatic images according to claim 1, wherein the polymer having the ratio of its Mw/Mn being 3.5 or more is present and said polymer is a polymer or copolymer of one or more kinds of styrene monomers selected from the group consisting of styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene; or copolymers of one or more kinds of styrene monomers mentioned above with one or more kinds of vinyl monomers selected from the group consisting of butadiene, α-methylene aliphatic mono-carboxylic acid esters, acrylic acid derivatives and methacrylic acid derivatives.

16. A toner for development of electrostatic images according to claim 15, wherein the Mw/Mn ratio of the polymer is 5 or more.

17. A toner for development of electrostatic images according to claim 15, wherein the molecular weight in terms of Mn of the polymer is in the range of 2,000 to 30,000.

18. A toner for development of electrostatic images according to claim 1, wherin the polymerizable monomer polymerizing in the presence of the reactive prepolymer is present and said polymerizable monomer is at least one selected from the group consisting of styrenes, ethylenic unsaturated mono-olefins, vinyl halides, vinyl esters, α-methylene aliphatic mono-carboxylic acid esters, acrylic acid derivatives, methacrylic acid derivatives, vinyl ethers, vinyl ketones, N-vinyl compounds, vinyl naphthalenes and polymerizable monomers.

19. A toner for deveopment of electrostatic images according to claim 18, wherein the reactive prepolymer is a prepolymer having a reactive group or an atom which is capable of being reactive with a polymerizable monomer at at least one of a main chain and a side chain of the polymer.

20. A toner for development of electrostatic images according to claim 19, wherein the reactive group of the reactive prepolymer is at least one selected from the group consisting of a carboxyl group, a sulfo group, an ethylene imino group, an isocyanate group, a ethylenic double bond group, an acid anhydride group, an epoxy group and a halogen atom.

21. A toner for development of electrostatic images according to claim 19, wherein the reactive prepolymer is at least one of butdiene series prepolymers selected from the group consisting of butadiene polymer, α,ω-polybutadiene homopolymer, α,ω-polybutadieneglycol, α,ω-polybutadiene dicarboxylic acid, maleic polybutadiene, terminal acryl-modified polybutadiene and terminal half-ester-modified polybutadiene.

22. A toner for development of electrostatic images according to claim 19, wherein the reactive prepolymer is unsaturated polyester resin prepared by the reaction of at least one of divalent alcohols and at least one of dibasic acids.

23. A toner for development of electrostatic images according to claim 19, wherein the reactive prepolymer is contained in the range of 0.1 to 40% by weight based on the whole polymer composition.

24. A toner for development of electrostatic images according to claim 1, wherein the polyolefin is a homopolymer prepared from a single olefin monomer or a copolymer obtained from an olefin monomer and a partner monomer capable of copolymerizing with the olefin monomer.

25. A toner for development of electrostatic images according to claim 24, wherein the olefin monomer is at least one selected from the group consisting of ethylene, propylene, butene-1, pentene-1, hexene-1, heptene-1, octene-1, nonene-1, decene-1, isomers thereof, 3-methyl-1-butene, 3-methyl-2-pentene and 3-propyl-5-methyl-2-hexene.

26. A toner for development of electrostatic images according to claim 24, wherein the partner monomer is at least one selected from the group consisting of vinyl ethers, vinyl esters, haloolefins, acrylic acid esters, methacrylic acid esters, acrylic acid derivatives, organic acids, diethyl fumalate and β-pinene.

27. A toner for development of electrostatic images according to claim 24, wherein the polyolefin is contained the olefin monomer as the polyolefin component in the range of 50 mole % or more.

28. A toner for development of electrostatic images according to claim 24, wherein the aromatic vinyl monomer is at least one selected from the group consisting of 1-phenylpropene, styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyreneand and 3,4-dichlorostyrene.

29. A toner for development of electrostatic images according to claim 1, wherein the toner comprises a binder resin comprising a polyester resin containing 5% by weight or more of its chloroform-insoluble content, and a wax comprising a polyolefin which has been block copolymerized or graft copolymerized with an aromatic vinyl monomer.

30. A toner for development of electrostatic images according to claim 1, wherein the toner comprises a binder resin comprising a polymer of a vinyl monomer containing 0.005% by weight or more of a cross-linking agent monomer with respect to the total monomers, and a wax comprising a polyolefin which has been block copolymerized or graft copolymerized with an aromatic vinyl monomer.

31. A toner for development of electrostatic images according to claim 1, wherein the toner comprises a binder resin comprising a styrene-butadiene copolymer containing 10% by weight or more of a high molecular weight component having a molecular weight of 100,000 or more, and a wax comprising a polyolefin which has been block copolymerized or graft copolymerized with an aromatic vinyl monomer.

32. A toner for development of electrostatic images according to claim 1, wherein the toner comprises a binder resin comprising a polymer of a styrene monomer or a copolymer of the styrene monomer and another vinyl monomer, a ratio of its weight average molecular weight Mw with respect to its number average molecular weight Mn being 3.5 or more, and a wax comprising a polyolefin which has been block copolymerized or graft copolymerized with an aromatic vinyl monomer.

33. A toner for development of electrostatic images according to claim 1, wherein the toner comprises a binder resin comprising a polymer formed by polymerization of a polymerizable monomer in the presence of a reactive prepolymer, and a wax comprising a polyolefin which has been block copolymerized or graft copolymerized with an aromatic vinyl monomer.

34. A toner for development of electrostatic images according to claim 2, wherein the polyolefin is a homopolymer prepared from a single olefin monomer or a copolymer obtained from an olefin monomer and a partner monomer capable of copolymerizing with the olefin monomer.

35. A toner for development of electrostatic images according to claim 34, wherein said aromatic vinyl monomer is present in an amount within the range of 0.1 to 15% by weight of said polyolefin.

* * * * *